US005866988A

United States Patent [19]

Oda

[11] Patent Number: 5,866,988

[45] Date of Patent: Feb. 2, 1999

[54] ELECTRON BEAM APPARATUS AND METHOD OF DRIVING THE SAME

[75] Inventor: Hitoshi Oda, Sagamihara, Japan

[73] Assignee: Canon Kabushiki Kaisha, Tokyo, Japan

[21] Appl. No.: 593,426

[22] Filed: Jan. 29, 1996

[30] Foreign Application Priority Data

Jan. 31, 1995 [JP] Japan ..... 7-032799
Jan. 26, 1996 [JP] Japan ..... 8-031224

[51] Int. Cl.[6] ..... G09G 3/10

[52] U.S. Cl. ..... 315/169.1; 315/169.3; 313/309; 313/310; 313/495

[58] Field of Search ..... 315/169.1, 169.3, 315/169.2, 326; 313/309, 495, 496, 310, 351; 445/51, 36; 257/10

[56] References Cited

U.S. PATENT DOCUMENTS

| | | | |
|---|---|---|---|
| 3,855,499 | 12/1974 | Yamada et al. | 315/169 R |
| 5,155,416 | 10/1992 | Suzuki et al. | 315/366 |
| 5,532,544 | 7/1996 | Yoshioka et al. | 313/310 |
| 5,594,296 | 1/1997 | Mitsutake et al. | 313/309 |
| 5,597,338 | 1/1997 | Iwai et al. | 445/51 |
| 5,622,634 | 4/1997 | Noma et al. | 216/40 |

FOREIGN PATENT DOCUMENTS

0619594A1 10/1994 European Pat. Off. .

OTHER PUBLICATIONS

M. Hartwell & C.G. Fonstad, "Strong Electron Emission from Patterned Tin–Indium Oxide Thin Films", IEEE International Electron Devices Meeting, No. Part 1, Dec. 1–3, 1975, New York, pp. 519–521.

The Experimental Physics Course No. 14: "Surface and Fine Particles", edited by Koreo Kinoshita; Kyoritu Publication 1986, pp. 193–195.

Chikara Hayashi, et al., "Ultrafine Particle Project–Creative Science and Technology", Mita Publication 1988, pp. 1–3.

C.A. Spindt, et al., "Physical Properties of thin–film field emission cathodes with molybdenum cones", Journal of Applied Physics, Dec. 1976, pp. 5248–5263.

Hisashi Araki, et al., "Electroforming and Electron Emission of Carbon Thin Films", Journal of the Vacuum Society of Japan, vol. 26, No. 1, pp. 22–29.

W.P. Dyke and W.W. Dolan, "Field Emission," Advances in Electronics and Electron Physics, vol. VIII, 1956, pp. 90–185.

C.A. Moad, "Operation of Tunnel–Emission Devices", Journal of Applied Physics, vol. 32, Jan.–Dec. 1961, pp. 646–652.

M.I. Elinson, et al., "The Emission of Hot Electrons and the Field Emission of Electrons from Tin Oxide", Radio Engineering and Electronic Physics, Jul. 1965, pp. 1290–1296.

G. Dittmer, "Electrical Conduction and Electron Emission of Discontinuous Thin Films", Thin Solid Films 9, 1972, pp. 317–328.

M. Hartwell, et al., "Strong Electron Emission From Patterned Tin–Indium Oxide Thin Films", IEDM, 1975, pp. 519–521.

*Primary Examiner*—Robert Pascal
*Assistant Examiner*—Haissa Philogene
*Attorney, Agent, or Firm*—Fitzpatrick, Cella, Harper & Scinto

[57] ABSTRACT

An electron beam apparatus comprises an electron-emitting device, an anode separated from the electron-emitting device by a distance H (m), means for applying a voltage Vf (V) to the device, and means for applying a voltage Va (V) to the anode. The device has an electron-emitting region arranged between a lower potential side electroconductive thin film which is connected to a lower potential side electrode and a higher potential side electroconductive thin film which is connected to a higher potential side electrode. The device also has a film containing a semiconductor substance with a thickness not greater than 10 nm. The semiconductor-containing film extends on the higher potential side electroconductive thin film from the electron-emitting region toward the higher potential side electrode over a length L (m). The above Vf, Va, H and L satisfy the relationship $L \geqq (1/\pi)\cdot(Vf/Va)\cdot H$.

44 Claims, 23 Drawing Sheets

ELECTRON BEAM APPARATUS AND METHOD OF DRIVING THE SAME

BACKGROUND OF THE INVENTION

1. Field of the Invention

This invention relates to an electron beam apparatus using electron-emitting devices and it also relates to a method of driving such an apparatus.

2. Related Background Art

There have been known two types of electron-emitting device: the thermionic type and the cold cathode type. Of these, the cold cathode type refers to devices including field emission type (hereinafter referred to as the FE type) devices, metal/insulation layer/metal type (hereinafter referred to as the MIM type) electron-emitting devices and surface conduction electron-emitting devices. Examples of FE type devices include those proposed by W. P. Dyke & W. W. Dolan, "Field Emission", Advances in Electron Physics, 8, 89 (1956) and C. A. Spindt, "physical Properties of Thin-Fields Field Emission Cathodes thin-film field emission cathodes with Molybdenum Cones", J. Appl. Phys., 47, 5248 (1976).

Examples of MIM devices are disclosed in various papers including C. A. Mead, "Operation of Tunnel-Emission Devices", J. Appl. Phys., 32, 646 (1961).

Examples of surface conduction electron-emitting devices include one proposed by M. I. Elinson, Radio Eng. Electron Phys., 10 (1965). A surface conduction electron-emitting device is realized by utilizing the phenomenon that electrons are emitted out by a small thin film formed on a substrate when an electric current is forced to flow in parallel with the film surface. While Elinson proposes the use of an $SnO_2$ thin film for a device of this type, the use of an Au thin film is proposed in G. Dittmer, "Thin Solid Films", 9, 317 (1972), whereas the use of $In_2O_3/SnO_2$ and of carbon thin film are discussed respectively in M. Hartwell and C. G. Fonstad, "IEEE Trans. ED Conf.", 519 (1975) and H. Araki et al., "Vacuum", Vol. 26, No. 1, p. 22 (1983).

FIG. 26 of the accompanying drawings schematically illustrates a typical surface conduction electron-emitting device proposed by M. Hartwell. In FIG. 26, reference numeral 121 denotes a substrate. Reference numeral 122 denotes an electroconductive thin film normally prepared by producing an H-shaped thin metal oxide film by means of sputtering, part of which eventually makes an electron-emitting region 123 when it is subjected to a current conduction treatment referred to as "energization forming" as will be described hereinafter. In FIG. 26, the narrow film arranged between a pair of device electrodes has a length G of 0.5 to 1 mm and a width W' of 0.1 mm.

Conventionally, an electron emitting region 123 is produced in a surface conduction electron-emitting device by subjecting the electroconductive thin film 122 of the device to a preliminary treatment, which is referred to as "energization forming". In an energization forming process, a constant DC voltage or a slowly rising DC voltage that rises typically at a rate of 1 V/min. is applied to given opposite ends of the electroconductive thin film 122 to partly destroy, deform or transform the film and produce an electron-emitting region 123 which is electrically highly resistive. Thus, the electron-emitting region 123 is part of the electroconductive thin film 122 that typically contains a fissure or fissures therein so that electrons may be emitted from the fissurer. Note that, once subjected to an energization forming process, a surface conduction electron-emitting device comes to emit electrons from its electron emitting region 123 whenever an appropriate voltage is applied to the electroconductive thin film 122 to make an electric current run through the device.

Known surface conduction electron-emitting devices include, beside the above-described device of M. Hartwell, one comprising an insulating substrate, a pair of oppositely disposed device electrodes of an electroconductive material formed on the substrate and a thin film of another electroconductive material arranged to connect the device electrodes. An electron-emitting region is produced in the electroconductive thin film when the latter is subjected to energization forming. Techniques that can be used for energization forming include that of applying a slowly rising voltage as described above and the one with which a pulse voltage is applied to an electron-emitting device and the wave height of the pulse voltage is gradually raised.

The intensity of the electron beam emitted from an electron-emitting device can be remarkably raised by carrying out an activation process on the electron-emitting device that has been subjected to an energization forming process. In an activation process, a pulse voltage is applied to the device that is placed in a vacuum chamber so that carbon or a carbon compound may be produced on the device by deposition at a location close to the electron-emitting region from an organic substance existing in the vacuum of the vacuum chamber.

Japanese Patent Application Laid-Open No. 6-141670 discloses a surface conduction electron-emitting device, its configuration and a method of manufacturing such a device.

However, when surface conduction electron-emitting devices are used in a flat type image-forming apparatus, the ratio of the electric current generated as a result of electron emission (emission current Ie) from the device to the electric current running through each device (device current If) is preferably made as large as possible in order to improve the electron emission efficiency of the device from the viewpoint of achieving a good quality for displayed images and, at the same time, reducing the power consumption rate of the device. A large emission current to device current ratio is particularly important for a high definition image-forming apparatus comprising a large number of pixels and is realized by arranging a large number of electron-emitting devices because such an apparatus inevitably consumes power at an enhanced rate and a considerable portion of the substrate of the apparatus that carries the electron-emitting devices thereon is occupied by wires connecting the devices. If each of the electron-emitting devices shows an excellent electron-emitting efficiency and consumes little power, smaller wires can be used, to provide a higher degree of freedom in designing the overall image-forming apparatus.

Further, in order to produce bright and clear images, not only the electron-emitting efficiency but also the emission current Ie of each device has to be improved.

Finally, each electron-emitting device is required to maintain its good performance of electron emission for a prolonged period in order for the image-forming apparatus comprising such devices to operate reliably for a long service life.

SUMMARY OF THE INVENTION

In view of the above identified technological problems, it is, therefore, an object of the present invention to provide an electron beam apparatus, or an image-forming apparatus in particular, comprising one or more electron-emitting devices having an improved electron-emitting efficiency.

Another object of the present invention is to provide an electron beam apparatus, or an image-forming apparatus in particular, comprising one or more electron-emitting devices having an improved emission current.

Still another object of the present invention is to provide a method of driving an electron beam apparatus, or an image-forming apparatus in particular, comprising one or more electron-emitting devices that can improve the electron-emitting efficiency of the electron-emitting devices.

A further object of the present invention is to provide a method of driving an electron beam apparatus, or an image-forming apparatus in particular, comprising one or more electron-emitting devices that can improve the emission current of the electron-emitting devices.

According to a first aspect of the invention, there is provided an electron beam apparatus comprising an electron-emitting device, an anode, means for applying a voltage Vf (V) to said electron-emitting device and means for applying another voltage Va (V) to said anode, said electron-emitting device and said anode being separated by a distance H (m), wherein said electron-emitting device has an electron-emitting region arranged between a lower potential side electroconductive thin film connected to a lower potential side electrode and a higher potential side electroconductive thin film connected to a higher potential side electrode and also has a film containing a semiconductor substance and having a thickness not greater than 10 nm, said semiconductor-containing film extending on said higher potential side electroconductive thin film from said electron-emitting region toward said higher potential side electrode over a length L (m) satisfying the relationship expressed by formula (1) below:

$$L \geq \frac{1}{\pi} \frac{Vf}{Va} H. \quad (1)$$

According to a second aspect of the invention, there is provide a method of driving an electron beam apparatus comprising an electron-emitting device having an electron-emitting region arranged between a lower potential side electroconductive thin film connected to a lower potential side electrode and a higher potential side electroconductive thin film connected to a higher potential side electrode and also having a film containing a semiconductor substance and having a thickness not greater than 10 nm, said semiconductor-containing film extending on said higher potential side electroconductive thin film from said electron-emitting region toward said higher potential side electrode over a length L (m), and an anode disposed as separated from said electron-emitting device by a distance H (m), wherein the electron beam apparatus is driven in such a way that voltage Vf (V) applied to said electron-emitting device and voltage Va (V) applied to said anode satisfies the relationship expressed by formula (1) below:

$$L \geq \frac{1}{\pi} \frac{Vf}{Va} H. \quad (1)$$

DETAILED DESCRIPTION OF THE PREFERRED EMBODIMENTS

Figure 1A:
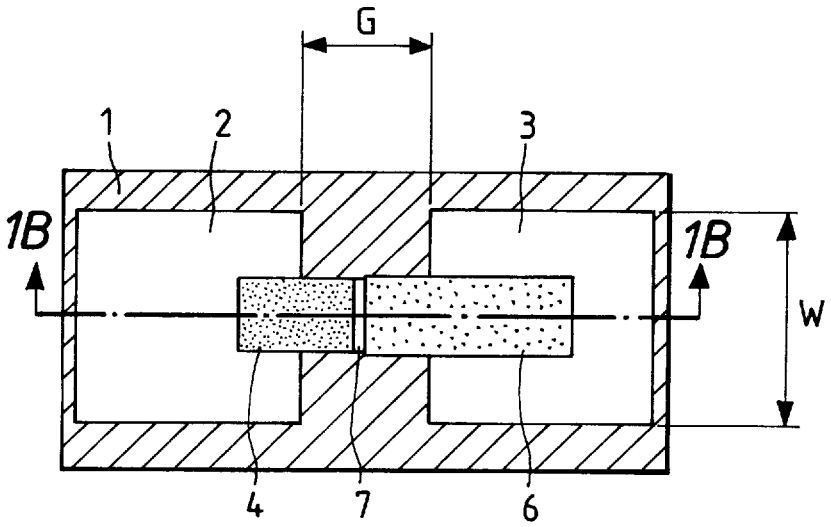
FIG. 1A is a schematic plan view of a surface conduction electron-emitting device that can be used for the purpose of the invention.
Figure 1B:
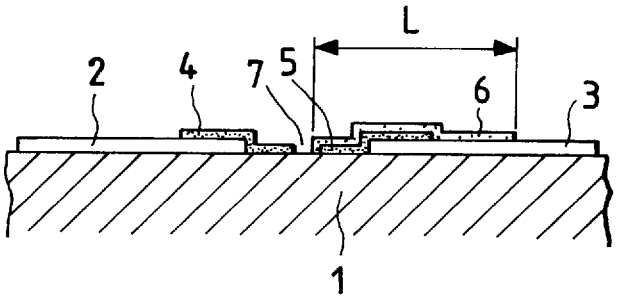
FIG. 1B is a schematic cross-sectional side view of the device of FIG. 1A taken along line 1B—1B.

FIGS. 1A and 1B schematically illustrate a surface conduction electron-emitting device prepared according to a first mode of realizing the present invention. It comprises an electron-scattering plane forming layer 6 arranged on the higher potential side electroconductive thin film 5 and, if necessary, also on the higher potential side device electrode of the device in order to provide a highly efficient electron-scattering plane that elastically scatters electrons striking the device from outside. FIG. 1A is a plane view and FIG. 1B is a cross-sectional side view taken along line 1B—1B in FIG. 1A. Reference numeral 1 denotes an insulating substrate, reference numerals 2 and 3 respectively denote lower and higher potential side device electrodes, reference numeral 4 denotes a lower potential side electrode, and reference numeral 7 denotes an electron-emitting region.

Figure 2:
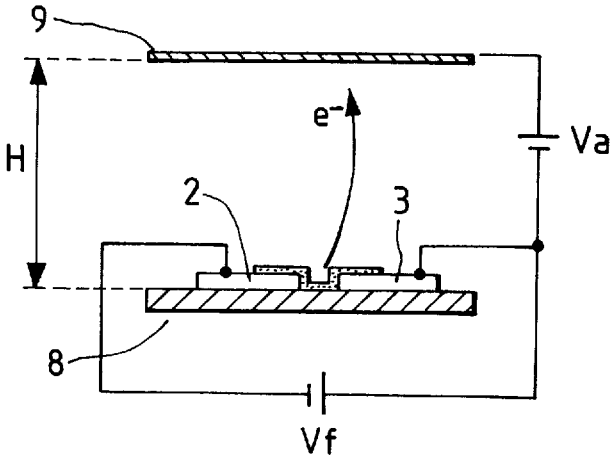
FIG. 2 is a schematic illustration showing the positional relationship between a surface conduction electron-emitting device and an anode arranged for the purpose of the invention.

The electron-scattering plane is a boundary plane of two different substances at which incident electrons are elastically scattered in a highly efficient way. The electron-scattering plane is formed on the higher potential side electroconductive thin film 5 and, if necessary, also on the higher potential side device electrode 3 and extending from the electron-emitting region 7 toward the higher potential side device electrode 3 over a length L that preferably satisfies the relationship expressed by formula (1) below:

$$L \geqq \frac{1}{\pi} \frac{Vf}{Va} H. \quad (1)$$

where Vf is the voltage (device voltage) applied between the oppositely disposed device electrodes 2 and 3 of the surface conduction electron-emitting device 8, Va is the voltage applied between the surface conduction electron-emitting device 8 and an anode 9, which will be described below, and H is the distance between the electron-emitting device and the anode. Referring to FIG. 2, an anode 9 is arranged vis-a-vis the surface conduction electron-emitting device 8 in order to effectively capture electrons coming from the electron-emitting device when the latter is driven to emit electrons.

Figure 4:
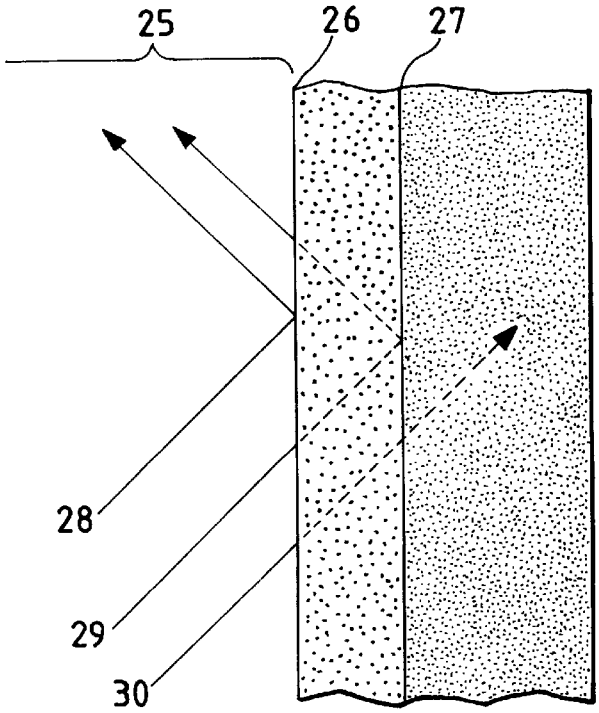
FIG. 4 is a schematic illustration showing the function of an electron-scattering plane.
Figure 5A:
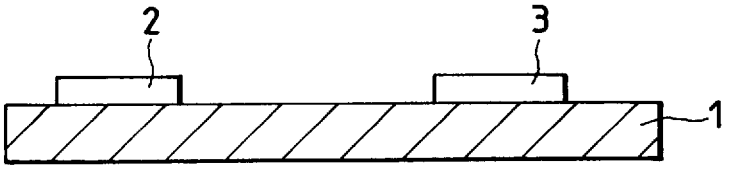
FIGS. 5A through 5D are schematic cross-sectional side views of a surface conduction electron-emitting device that can be used for the purpose of the invention, showing different manufacturing steps.
Figure 5B:
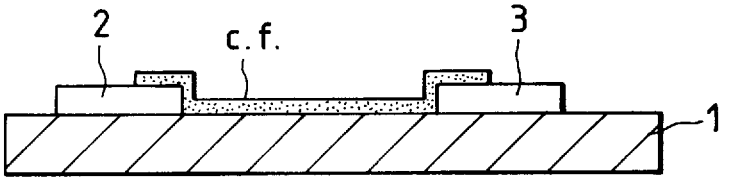
Figure 5C:
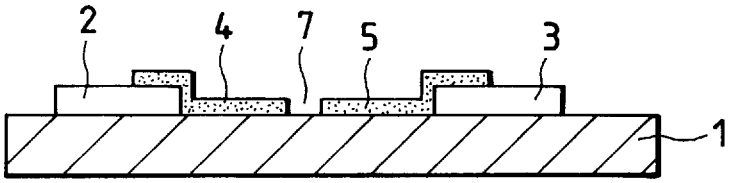
Figure 5D:
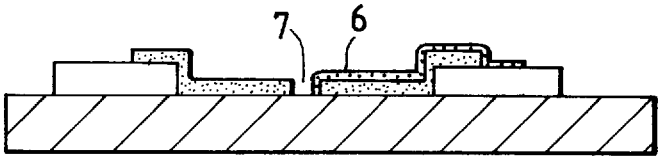

The effect of an electron-scattering plane for efficiently scattering electrons may be given rise to in a manner as described below by referring to FIG. 4. In FIG. 4, reference 25 denotes a vacuum space and external electrons come to strike the electron-scattering plane forming layer by way of this space. Reference numeral 26 denotes the surface of an electron-scattering plane forming layer that reflects and scatters part of incident electrons to give rise to their respective tracks, only one of which is shown there, indicated by reference numeral 28. A boundary plane is formed under the surface and operates as an electron-scattering plane 27. This plane is defined as a boundary plane of either of the first and second layers of an electron-scattering plane forming layer or an electron-scattering plane forming layer and the higher potential side electroconductive thin film, although its function is the same in both cases. Some of the electrons passing through the surface 26 of the electron-scattering plane forming layer are reflected and scattered by this electron-scattering plane to fly into the vacuum space to give rise to their respective tracks, only one of which is shown there, indicated by reference numeral 29. The remaining electrons that pass through the electron-scattering plane 27 will eventually lose the energy they have and will not fly back into the vacuum space, as indicated by reference numeral 30. Thus, it will be safe to assume that an electron-scattering plane 27 effectively and efficiently produces scattered electrons that fly back into the vacuum space.

If the distance, or the depth, of the electron-scattering plane 27 from the surface 26 of the electron-scattering plane forming layer is too large, electrons can lose the energy they have while they are traveling therebetween to reduce the electron scattering efficiency of the electron-scattering plane.

If the electron-scattering plane forming layer has a double-layered configuration, the first and second layers are prepared from different materials in order to produce a good electron scattering effect. Preferably, the materials of the two layers are so selected as to make the electron-scattering plane show a large potential difference. A large potential difference may be obtained when both the electronegativities and the work functions of the two materials show a large difference. As will be described hereinafter, a favorable effect can be achieved when semiconductor substances, specifically Si and B, are used for the first layer and metals of the III*b* group, specifically La and Sc, or those of the II*a* group, specifically Sr and Ba, are used for the second layer. However, materials that can be used for these two layers are not limited to those listed above, and many other materials may be used if they produce a highly efficient elastic electron scattering effect on the electron scattering plane.

Now, a surface conduction electron-emitting device that can be used for the purpose of the invention will be described in greater detail.

Materials that can be used for the substrate 1 include quartz glass, glass containing impurities such as Na to a reduced concentration level, soda lime glass, a glass substrate realized by forming an $SiO_2$ layer on soda lime glass by means of sputtering, and ceramic substances such as alumina, as well as Si. While the oppositely arranged lower and higher potential side device electrodes 2 and 3 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, Au, $RuO_2$, Pd-Ag, etc., in combination with glass, transparent conducting materials such as $In_2O_3$—$SnO_2$ and semiconductor materials such as polysilicon.

Referring to FIGS. 1A and 1B, the gap length G separating the device electrodes 2 and 3, the length W of the device electrodes, the contours of the lower and higher potential side electroconductive films 4 and 5 and other factors for designing a surface conduction electron-emitting device according to the invention may be determined depending on the-application of the device. The gap length G separating the device electrodes 2 and 3 is preferably between hundreds of nanometers and hundreds of micrometers and, still preferably, between several micrometers and several tens of micrometers.

The length W of the device electrodes 2 and 3 is preferably between several micrometers and several hundreds of micrometers depending on the resistance of the electrodes and the electron-emitting characteristics of the device. The film thickness d of the device electrodes is between tens of several tens of nanometers and several micrometers.

A surface conduction electron-emitting device according to the invention may have a configuration other than the one illustrated in FIGS. 1A and 1B and, alternatively, it may be prepared by laying electroconductive thin films 4 and 5 on a substrate 1 and then oppositely disposed lower and higher potential side device electrodes 2 and 3.

The electroconductive thin films 4 and 5 are preferably fine particle films in order to provide excellent electron-emitting characteristics. The thickness of the electroconductive thin films is determined as a function of the stepped coverage of the electroconductive thin films on the device electrodes 2 and 3, the electric resistance between the device electrodes 2 and 3 and the parameters for the forming operation that will be described later as well as other factors and preferably between several tenths of a nanometers and several hundreds of nanometers and more preferably between a nanometer and fifty nanometers. The electroconductive thin films 4 and 5 normally show a sheet resistance Rs between $10^2$ and $10^7\Omega/\square$. Note that Rs is the resistance defined by R=Rs(l/w), where t, w and l are the thickness, the width and the length of a thin film respectively and R is the resistance determined along the longitudinal direction of the thin film. Also note that, while the forming process is described in terms of current conduction treatment for the purpose of the present invention, it is not limited thereto and may include a variety of processing steps where a fissure is formed in the thin film to produce a high resistance state there.

The electroconductive thin films 4 and 5 are made of fine particles of a material primarily selected from metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such TiC, ZrC, HfC, TaC, SiC and WC, nitrides such as TiN, ZrN and HfN, and the like.

The term a "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between tenths of a several nanometers and several hundreds of several nanometers and preferably between a nanometer and twenty nanometers.

Since the term "fine particle" is frequently used herein, it will be described in greater depth below.

A small particle is referred to as a "fine particle" and a particle smaller than a fine particle is referred to as an "ultrafine particle". A particle smaller than an "ultrafine particle" and constituted by several hundred atoms is referred to as a "cluster".

However, these definitions are not rigorous and the scope of each term can vary depending on the particular aspect of the particle to be dealt with. An "ultrafine particle" may be referred to simply as a "fine particle" as in the case of this patent application.

"The Experimental Physics Course No. 14: Surface/Fine Particle" (ed., Koreo Kinoshita; Kyoritu Publication, Sep. 1, 1986) describes as follows:

"A fine particle as used herein refers to a particle having a diameter somewhere between 2 to 3 $\mu$m and 10 nm and an ultrafine particle as used herein means a particle having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two atoms to several tens or hundreds of atoms is called a cluster." (Ibid., p.195, 11.22–26)

Additionally, "Hayashi's Ultrafine Particle Project" of the New Technology Development Corporation defines an "ultrafine particle" as follows, employing a smaller lower limit for the particle size:

"The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to $10^8$ atoms. From the viewpoint of atom, an ultrafine particle is a huge or ultrahuge particle." ("Ultrafine Particle-Creative Science and Technology": ed., Chikara Hayashi, Ryoji Ueda, Akira Tazaki; Mita Publication, 1988, p.2, 11.1–4) "A particle smaller than an ultrafine particle and constituted by several to several hundred atoms is referred to as a cluster. (Ibid., p.2, 11.12–13)

Taking the above general definitions into consideration, the term "a fine particle" as used herein refers to an agglomerate of a large number of atoms and/or molecules having a diameter with a lower limit between a tenth of several nanometers and a nanometer and with an upper limit of several micrometers.

The electron-emitting region 7 is formed between the lower potential side and higher potential side electroconductive thin films 4 and 5 and comprises an electrically highly resistive fissure, although its performance is dependent on the thickness, the nature and the material of the electroconductive thin films 4 and 5 and the energization forming process which will be described hereinafter. The electron emitting region 7 may contain in the inside electroconductive fine particles having a diameter between a tenth of several nanometers and tens of several nanometers. The material of such electroconductive fine particles may contain all or part of the materials that can be used to prepare the electroconductive thin films 4 and 5 including the electron emitting region.

Figures 2, 17A:
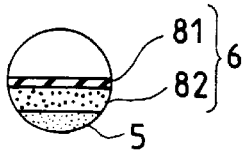
FIG. 17A is a schematic cross-sectional side view of a surface conduction electron-emitting device provided with an electron-scattering plane forming layer having a double-layered configuration on the higher potential side.
Figures 1, 17A:
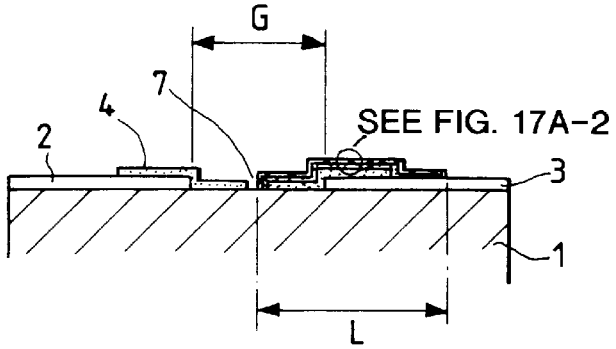

Subsequently, an electron-scattering plane forming layer 6 is produced. This will be described in terms of an electron-scattering plane forming layer having a double-layered configuration. (FIG. 17A schematically illustrates such a double-layered configuration.)

Firstly the second layer of an electron-scattering plane forming layer 6 is produced on the higher potential side electroconductive thin film 5. Techniques that can be used for this operation include vacuum evaporation and sputtering as well as chemical techniques such as MOCVD (metal organic chemical vapor deposition). Two or more than two such techniques may be used in combination.

If the technique of vacuum evaporation or sputtering is used, a patterning operation has to be conducted in order to form a film only in necessary areas. If the technique of MOCVD is used, to the contrary, a film can be formed selectively on the higher potential side device electrode 3 and the higher potential side electroconductive thin film 5, although the produced films may not necessarily show a desired profile because there may be areas where a film can easily grow and areas where a film cannot easily grow depending on surface configuration or other factors of the device. If such is the case, MOCVD may be used for areas near the electron-emitting region 7, while vacuum evaporation or sputtering may be used for the remaining areas.

Materials that can be used for the second layer include metals of the 2*a* and 3*a* groups, specifically Sr, Ba, Sc and La. Any of these substances can be used in combination with one of the materials that can be used for the first layer, which will be described hereinafter. Source gases that can be used for CVD for the second layer include $Sr(C_{11}H_{19}O_2)_3$, $Ba(C_{11}H_{19}O_2)_3$, $Sc(C_{11}H_{19}O_2)_3$ and $La(C_{11}H_{19}O_2)_3$.

Figures 2, 17B:
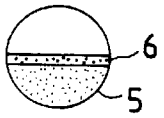
FIG. 17B is a schematic cross-sectional side view of a surface conduction electron-emitting device provided with an electron-scattering plane forming layer having a single-layered configuration on the higher potential side.
Figures 1, 17B:
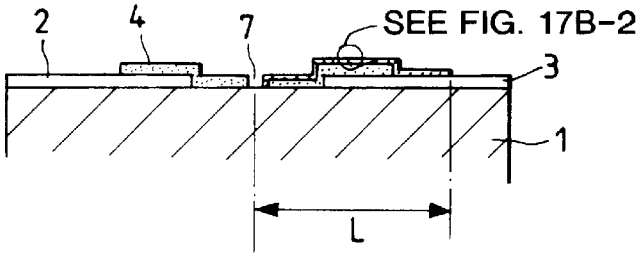

Note that the second layer is not necessary if the boundary plane of the first layer and the electroconductive thin film is used for an electron-scattering plane. (FIG. 17B schematically illustrates such a single-layered configuration.)

Then, the first layer is formed. The methods that can be used for forming the second layer can also be used for the first layer. While materials that can be used for the first layer include semiconductor substances, the use of Si or B is preferable. The film thickness of the first layer has to be rigorously controlled to less than 10 nm, preferably less than 5 nm, because the film thickness of the first layer significantly affects the efficiency of elastic electron-scattering of the device. Source gases that can be used for CVD for the first layer include $SiH_4$ and $B(C_2H_5)_3$.

Note that the two component layers of an electron-scattering plane forming layer having a double-layered configuration are not necessarily arranged continuously and they may be layered in a discontinuous manner.

Now, the right side of formula (1) will be described below.

Figure 3:
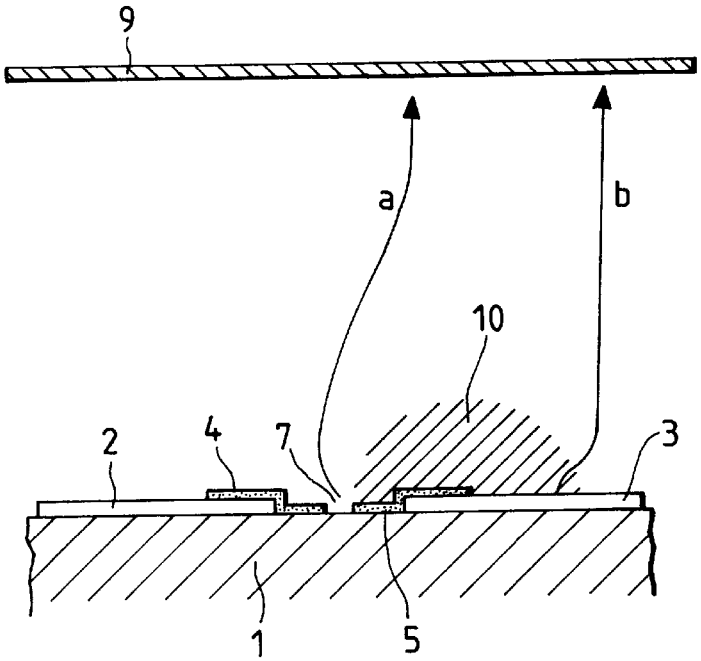
FIG. 3 is a schematic illustration showing two possible trajectories of an electron emitted from a surface conduction electron-emitting device for the purpose of the invention.

For driving a surface conduction electron-emitting device to emit electrons, values for Vf, H and Va are selected respectively from somewhere between ten and several tens of volts (V), 2 and 8 millimeters (mm) and 1 and 10 kilovolts (kV). By looking into the electric field formed by the electron-emitting device and the anode under these conditions, it will be found that electrons in a region above the higher potential side electroconductive thin film 5 are subjected to a downward force directed to the higher potential side electroconductive thin film 5 or the device electrode 3. FIG. 3 schematically illustrates such a region indicated by oblique lines and denoted by reference numeral 10. In this region, electrons are subjected to a downward force due to the electric field generated there.

The region extends from the electron-emitting region toward the higher potential side device electrode for a distance of $$\frac{1}{\pi}\ \frac{Vf}{Va}\ H \tag{2}$$

which is the same as the right side of formula (1).

Most of the electrons emitted from the electron-emitting region cannot leave the slashed region of FIG. 3 immediately because of the downward force of the electric field applied to them and strike the electron-scattering plane forming layer. The incident electrons are scattered and/or absorbed by the layer. Electrons are scattered either elastically without losing the energy they have or non-elastically, losing part of the energy they have. Further, secondary electrons may be emitted by incident electrons. Since the energy level of electrons scattered non-elastically and those energized and emitted secondarily by incident electrons is lower than that of elastically scattered electrons, they cannot overcome the downward force exerted by the electric field and hence cannot leave the slashed region so that they are eventually absorbed by the higher potential side electroconductive thin film 5 or the device electrode 3 and take part in the device current If. Thus, only electrons that are elastically scattered can overcome the downward force of the electric field and eventually leave the region to produce an emission current.

Electrons emitted from the electron-emitting region 7 show a certain spread angle. While some of them may immediately get out of the slashed region of FIG. 3 and fly toward the anode 9 as indicated by trajectory a, most of them are pulled back by the downward force of the electric field existing there and enter the electron-scattering plane forming layer 6. A given portion of these electrons are elastically scattered and eventually leave the slashed region 10 to get to the anode 9. Once they leave the electron-emitting region by the distance expressed by formula 2, the force applied to them by-the electric field is directed upward so that they may produce their respective trajectories that get to the anode such as trajectory b illustrated in FIG. 3.

Electrons emitted from the electron-emitting region may be elastically scattered by the electroconductive thin film 3 with a non-zero probability if an electron-scattering plane forming layer 6 is not provided. However, the probability with which electrons are elastically scattered is remarkably increased by arranging an electron-scattering plane forming layer 6 to increase the ratio of "surviving" electrons and hence the electron emitting efficiency of the device. Preferably, the electron-scattering plane forming layer 6 is made to entirely cover the higher potential side electroconductive thin film 5 that is directly neighboring the slashed region 10 of FIG. 3 and, if the region 10 gets to the surface of the higher potential side device electrode 3 that does not carry thereon any electroconductive thin film, it may preferably be extended to the surface of the electrode 3 or made longer than the length expressed by formula (2).

A surface conduction electron-emitting device prepared according to a second mode of realizing the present invention comprises, in addition to the components of a device of the first mode of realization, a low work function material layer 83 arranged on the lower potential side electroconductive thin film 4 at least in an area close to the electron-emitting region 7. With such an arrangement, the emission current Ie of the device can be significantly increased.

Materials that can be used for the low work function material layer 83 include metals of the II*a* and III*b* groups, which may also be used for one of the double layers constituting the electron-scattering plane forming layer 6, if the latter has a double-layered configuration. In other words, the two layers can be produced in a single manufacturing step and, therefore, an electron-emitting device according to the first mode and a device according to the second mode of realizing the present invention can be manufactured with a same number of manufacturing steps, although they may alternatively be manufactured with different manufacturing steps.

A surface conduction electron-emitting device prepared according to a third mode of realizing the present invention comprises, in addition to the components of a device of the first mode of realization, a high melting point substance layer 84 arranged on the lower potential side electroconductive thin film 4 at least in an area close to the electron-emitting region 7.

If the high melting point substance layer 6 is made of a material that is also used in the electron-scattering plane forming layer 6 like the case of a device according to the second mode of realizing the invention, the above manufacturing method as described for the second mode of realization may also be used. Materials of the high melting point substance layer, however, is generally different from that of the electron-scattering plane forming layer. A high melting point substance layer 84 may well be formed by deposition in an area of the electron-emitting region located close to the lower potential side electroconductive thin film by applying a positive pulse voltage to the lower potential side electroconductive thin film, which is opposite to the case of driving the device, and using a CVD technique in an atmosphere containing an appropriate source gas.

Materials that can be used for the high melting point substance layer 84 include the metals of the IV*b*, V*b*, VI*b*, VII*b* and VIII groups in the fifth and sixth periods, any of which may be used as an independent metal, as an alloy or as a mixture thereof. More specifically, any of Nb, Mo, Ru, Hf, Ta, W, Re, Os and Ir may be used as an independent metal because they show a melting point higher than 2,000° C. Either of Zr and Rh may also be used as an independent metal because they have a melting point close to 2,000° C. For the purpose of the present invention, the temperature at which the material for the high melting point substance layer gives rise to a vapor pressure of $1.3\times10^{-3}$Pa ($10^{-5}$Torr) is of particular interest from the viewpoint that the film may be partly sublimated as it is heated to degrade its performance. While Pd gives rise to the above vapor pressure at 1,100° C., the corresponding temperatures of W, Ta, Re, Os and Nb are respectively 2,570° C., 2,410° C., 2,380° C., 2,330° C. and 2,120° C. and, therefore, any of these substances may preferably be used for the purpose of the invention. Particularly, the use of W is most preferable because its melting point is 3,380° C. which is higher than those of the other metals.

Source gases that can be used to deposit these metals by CVD include $NbF_5$, $NbCl_5$, $Nb(C_5H_5)(CO)_4$, $Nb(C_5H_5)_2Cl_2$, $OsF_4$, $Os(C_3H_7O_2)_3$, $Os(CO)_5$, $Os_3(CO)_{12}$, $Os(C_5H_5)_2$, $ReF_5$, $ReCl_5$, $Re(CO)_{10}$, $ReCl(CO)_5$, $Re(CH_3)(CO)_5$, $Re(C_5H_5)(CO)_3$, $Ta(C_5H_5)(CO)_4$, $Ta(OC_2H_5)_5$, $Ta(C_5H_5)_2Cl_2Ta(C_5H_5)_2H_3$, $WF_5$, $W(CO)_6$, $W(C_5H_5)_2Cl_2$, $W(C_5H_5)_2H_2$ and $W(CH_3)_6$.

With the arrangement of a high melting point substance layer, possible reduction with time of the emission current of a surface conduction electron-emitting device can be significantly suppressed.

The electron-emitting performance of an electron-emitting device prepared according to any of the first through third modes of realizing the present invention as described above will now be described by referring to FIG. 7 and FIGS. 8A and 8B.

Figure 7:
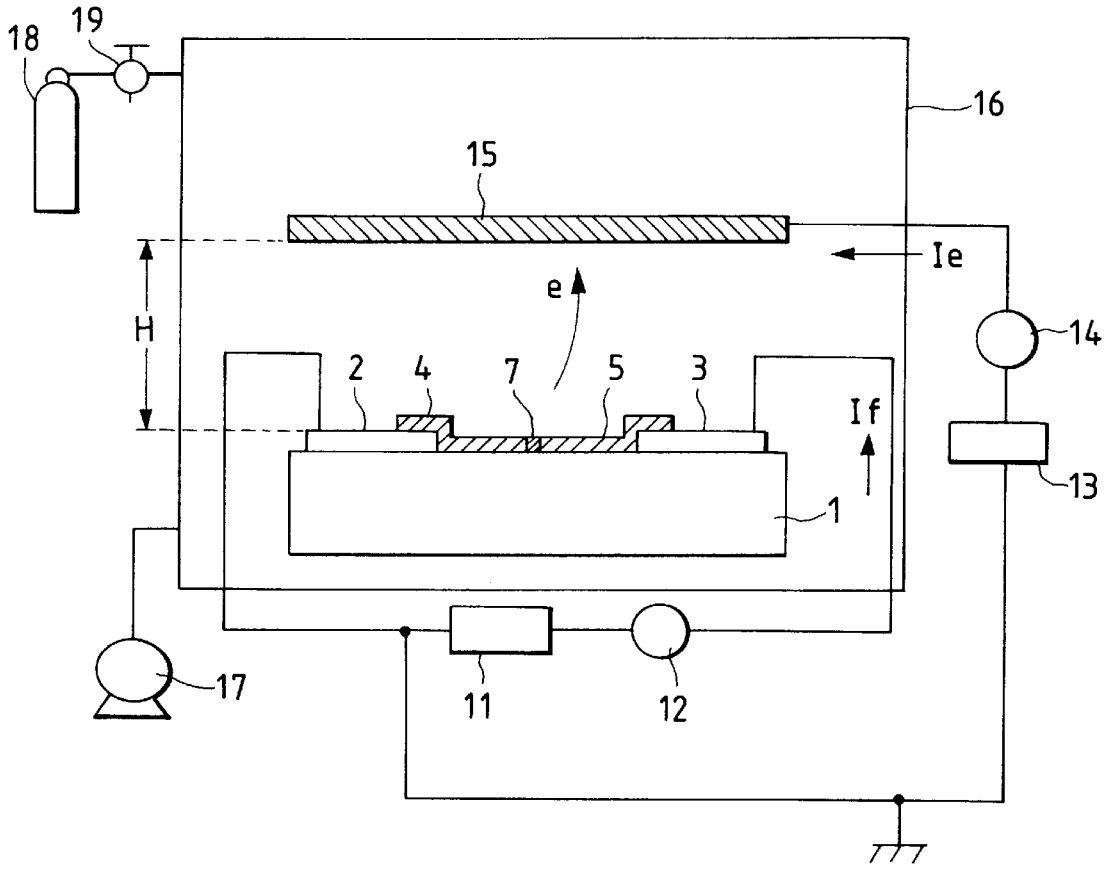
FIG. 7 is a schematic diagram of a vacuum processing apparatus that can be used for manufacturing a surface conduction electron-emitting device and evaluating the performance of the device for the purpose of the invention.

FIG. 7 is a schematic block diagram of an arrangement comprising a vacuum chamber that can be used as a gauging system for determining the performance of an electron emitting device of the type under consideration. Referring to FIG. 7, the gauging system includes a vacuum chamber 16 and a vacuum pump 17. An electron-emitting device is placed in the vacuum chamber 16. The device comprises a substrate 1, lower and higher potential side device electrodes 2 and 3, lower and higher potential side thin films 4 and 5 and an electron-emitting region 7. Although not shown in FIG. 7, the device additionally comprises an electron-scattering plane forming layer, a low work function material layer and/or a high melting point substance layer. Otherwise, the gauging system has a power source 11 for applying a device voltage Vf to the device, an ammeter 12 for metering the device current If running through the thin films 4 and 5 between the device electrodes 2 and 3, an anode 15 for capturing the emission current Ie produced by electrons emitted from the electron-emitting region 7 of the device, a high voltage source 13 for applying a voltage to the anode 15 of the gauging system and another ammeter 14 for metering the emission current Ie produced by electrons emitted from the electron-emitting region 7 of the device. For determining the performance of the electron-emitting device, a voltage between 1 and 10 kV may be applied to the anode, which is spaced apart from the electron emitting device by distance H which is between 2 and 8 mm.

Instruments including a vacuum gauge and other pieces of equipment necessary for the gauging system are arranged in the vacuum chamber 16 so that the performance of the electron-emitting device or the electron source in the chamber may be properly tested under desired atmosphere. The vacuum pump 17 may be provided with an ordinary high vacuum system comprising a turbo pump and a rotary pump and an ultra-high vacuum system comprising an ion pump. The entire vacuum chamber containing an electron source substrate therein can be heated to 250° C. by means of a heater (not shown). Thus, this vacuum processing arrangement can be used for the "forming" process and the subsequent processes. Reference numeral 18 denotes a substance source for storing a substance to be introduced into the vacuum chamber whenever necessary. It may be an ampule or a cylinder. Reference numeral 19 denotes a valve to be used to regulate the rate of supplying the substance into the vacuum chamber.

Figure 8A:
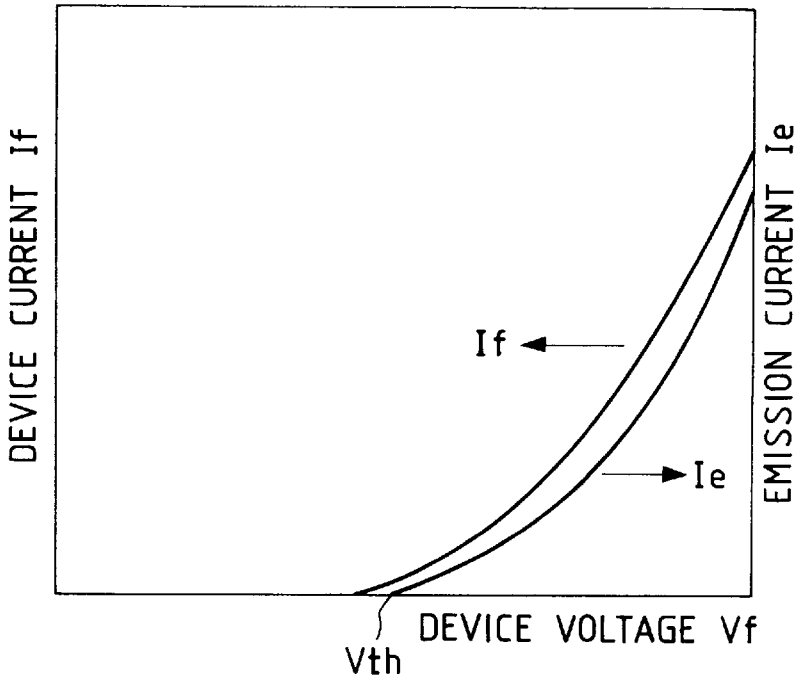
FIGS. 8A and 8B are graphs schematically illustrating the electron-emitting performance of a surface conduction electron-emitting device for the purpose of the invention.

FIG. 8A shows a graph schematically illustrating the relationship between the device voltage Vf and the emission current Ie and the device current If typically observed by the gauging system of FIG. 7. Note that different units are arbitrarily selected for Ie and If in FIG. 8A in view of the fact that Ie has a magnitude by far smaller than that of If. Note that both the vertical and transversal axes of the graph represent linear scales.

As seen in FIG. 8A, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 8A), whereas the emission current Ie is practically undetectable when the applied voltage is lower than the threshold value Vth. Differently stated, an electron-emitting device according to the invention is a non-linear device having a clear threshold voltage Vth to the emission current Ie.

(ii) Secondly, since the emission current Ie increases monotonically dependent on the device voltage Vf, the former can be effectively controlled by way of the latter.

(iii) Thirdly, the emitted electric charge captured by the anode 35 is a function of the duration of time of application of the device voltage Vf. In other words, the amount of electric charge captured by the anode 15 can be effectively controlled by way of the time during which the device voltage Vf is applied.

Because of the above remarkable features, it will be understood that the electron-emitting behavior of an electron source comprising a plurality of electron-emitting devices according to the invention and hence that of an image-forming apparatus incorporating such an electron source can easily be controlled in response to the input signal. Thus, such an electron source and an image-forming apparatus may find a variety of applications.

Figure 8B:
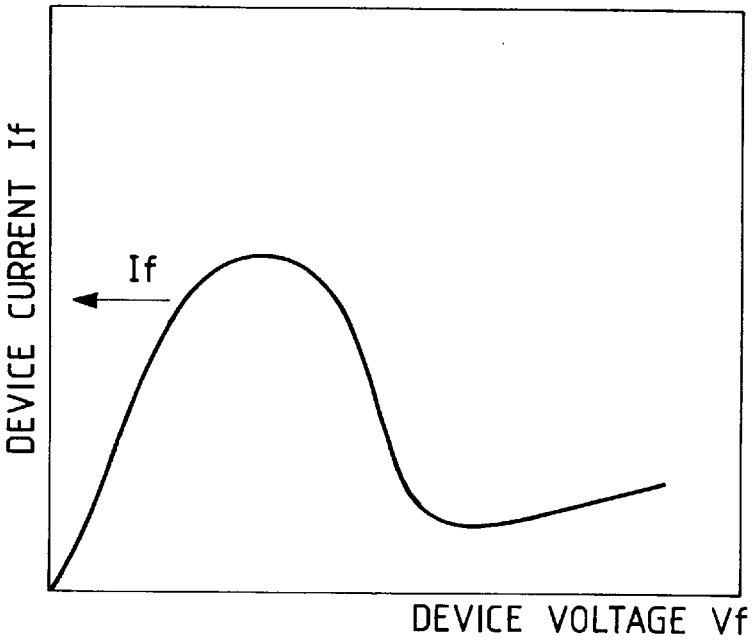

On the other hand, the device current If either monotonically increases relative to the device voltage Vf (as shown in FIG. 8A, a characteristic referred to as "MI characteristic" hereinafter) or changes to show a curve specific to a voltage-controlled-negative-resistance characteristic (a characteristic referred to as "VCNR characteristic" hereinafter) as shown in FIG. 8B. These characteristics of the device current are dependent on the manufacturing method.

Now, some examples of the usage of electron-emitting devices, to which the present invention is applicable, will be described.

According to a fourth mode of realizing the invention, an electron source and hence an image-forming apparatus can be realized by arranging on a substrate a plurality of electron-emitting devices according to any of the above described first through third modes of realizing the present invention, and including the thus obtained electron source and an image-forming member within a vacuum container.

Electron-emitting devices may be arranged on a substrate in a number of different modes.

For instance, a number of electron-emitting devices may be arranged in parallel rows along a direction (hereinafter referred to row direction), each device being connected by wires at opposite ends thereof, and driven to operate by control electrodes (hereinafter referred to as grids) arranged in a space above the electron-emitting devices along a direction perpendicular to the row direction (hereinafter referred to as column-direction) to realize a ladder-like arrangement. Alternatively, a plurality of electron-emitting devices may be arranged in rows along a X-direction and columns along an Y-direction to form a matrix, the X- and Y-directions being perpendicular to each other, and the electron-emitting devices on a given row are connected to a common X-directional wire by way of one of the electrodes of each device while the electron-emitting devices on a given column are connected to a common Y-directional wire by way of the other electrode of each device. The latter arrangement is referred to as a simple matrix arrangement. Now, the simple matrix arrangement will be described in detail.

In view of the above described three basic characteristic features (i) through (iii) of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electrons below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 9:
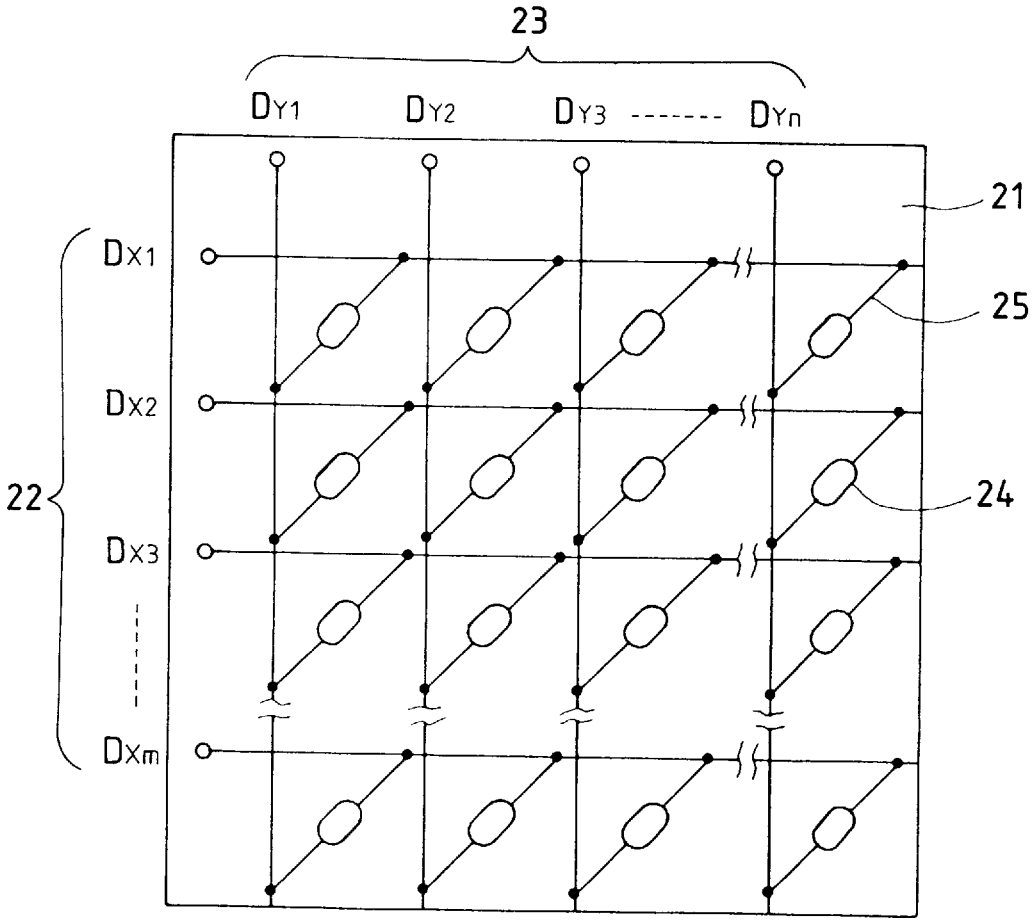
FIG. 9 is a schematic plan view of an electron source having a matrix wiring arrangement.

FIG. 9 is a schematic plan view of the substrate of an electron source realized by arranging a plurality of electron-emitting devices, to which the present invention is applicable, in order to exploit the above characteristic features. In FIG. 9, the electron source comprises a substrate 21, X-directional wires 22, Y-directional wires 23, surface conduction electron-emitting devices 24 and connecting wires 25.

There are provided a total of m X-directional wires 22, which are denoted by Dx1, Dx2, . . . , Dxm and made of an electroconductive metal produced by vacuum evaporation, printing or sputtering. These wires are so designed in terms of material, thickness and width that, if necessary, a substantially equal voltage may be applied to the surface conduction electron-emitting devices. A total of n Y-directional wires 23 are arranged and denoted by Dy1, Dy2, . . . , Dyn, which are similar to the X-directional wires 23 in terms of material, thickness and width. An interlayer insulation layer (not shown) is disposed between the m X-directional wires 22 and the n Y-directional wires 23 to electrically isolate them from each other. (Both m and n are integers.)

The interlayer insulation layer (not shown) is typically made of $SiO_2$ and formed on the entire surface or part of the surface of the insulating substrate 21 to show a desired contour by means of vacuum evaporation, printing or sputtering. For example, it may be formed on the entire surface or part of the surface of the substrate 21 on which the X-directional wires 22 have been formed. The thickness, material and manufacturing method of the interlayer insulation layer are so selected as to make it withstand the potential difference between any of the X-directional wires 22 and any of the Y-directional wires 23 observable at the crossing thereof. Each of the X-directional wires 22 and the Y-directional wires 23 is drawn out to form an external terminal.

The oppositely arranged paired electrodes (not shown) of each of the surface conduction electron-emitting devices 24 are connected to related one of the m X-directional wires 22 and related one of the n Y-directional wires 23 by respective connecting wires 25 which are made of an electroconductive metal.

The electroconductive material of the device electrodes and that of the connecting wires 25 extending from the wire 22 and 23 may be same or contain a common element as an ingredient. Alternatively, they may be different from each other. These materials may be appropriately selected typically from the candidate materials listed above for the device electrodes. If the device electrodes and the connecting wires are made of the same material, they may be collectively called device electrodes without discriminating the connecting wires.

The X-directional wires 22 are electrically connected to a scan signal application means (not shown) for applying a scan signal to a selected row of surface conduction electron-emitting devices 24. On the other hand, the Y-directional wires 23 are electrically connected to a modulation signal generation means (not shown) for applying a modulation signal to a selected column of surface conduction electron-emitting devices 24 and modulating the selected column according to an input signal. Note that the drive signal to be applied to each surface conduction electron-emitting device is expressed as the voltage difference of the scan signal and the modulation signal applied to the device.

With the above arrangement, each of the devices can be selected and driven to operate independently by means of a simple matrix wire arrangement.

Figure 10:
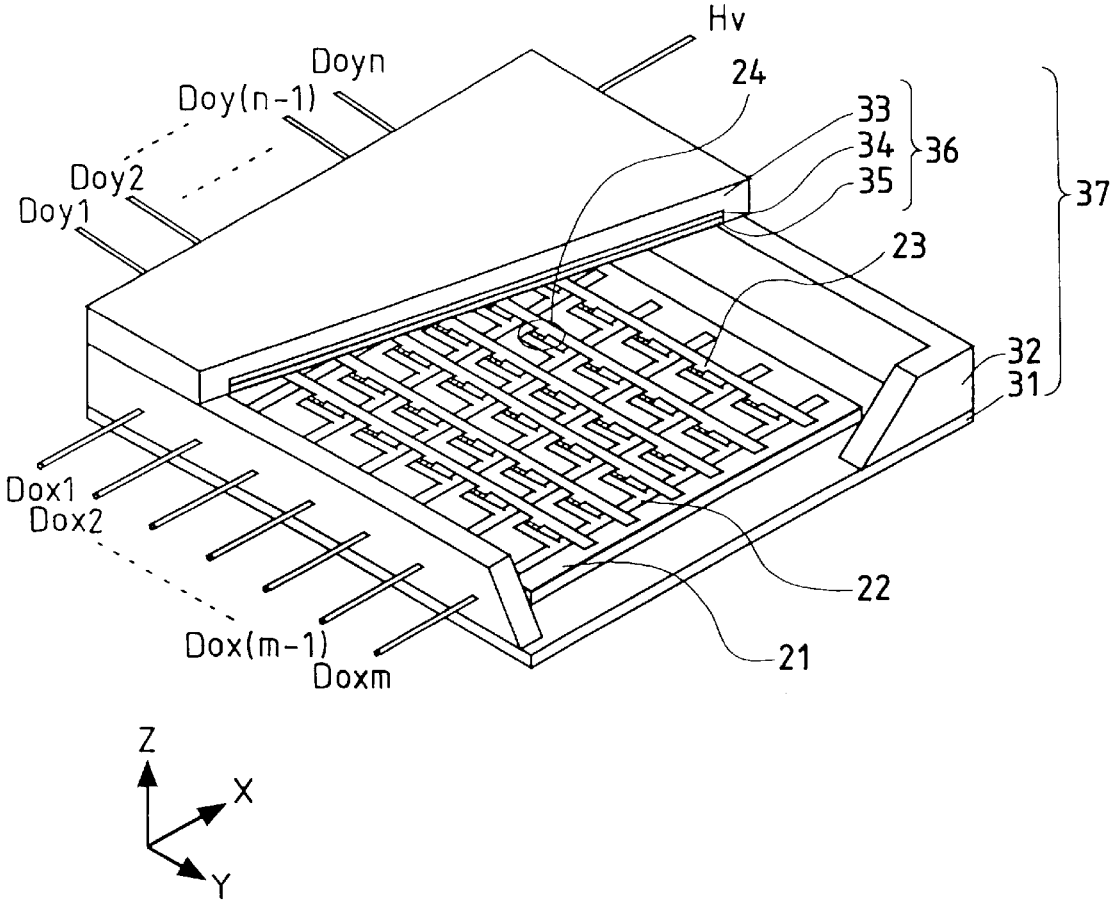
FIG. 10 is a schematic perspective view of an image-forming apparatus comprising an electron source having a matrix wiring arrangement.
Figure 11A:
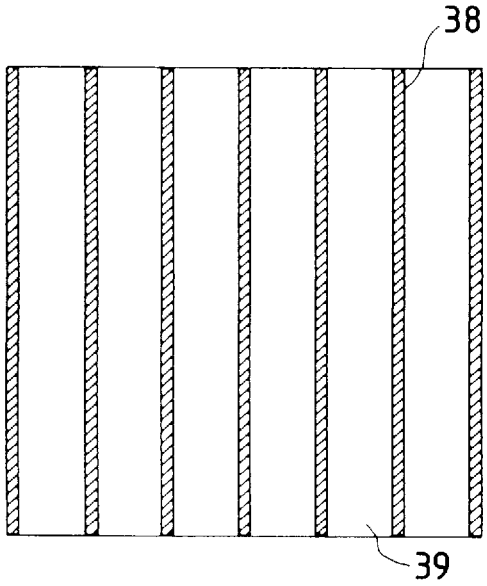
FIGS. 11A and 11B are two possible arrangements of fluorescent members that can be used for the purpose of the invention.
Figure 11B:
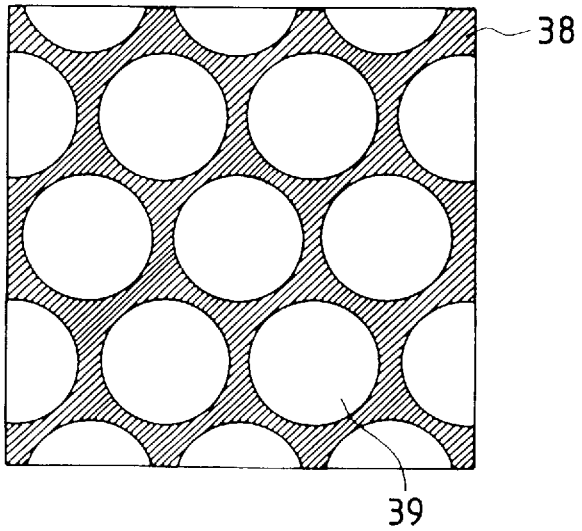
Figure 12:
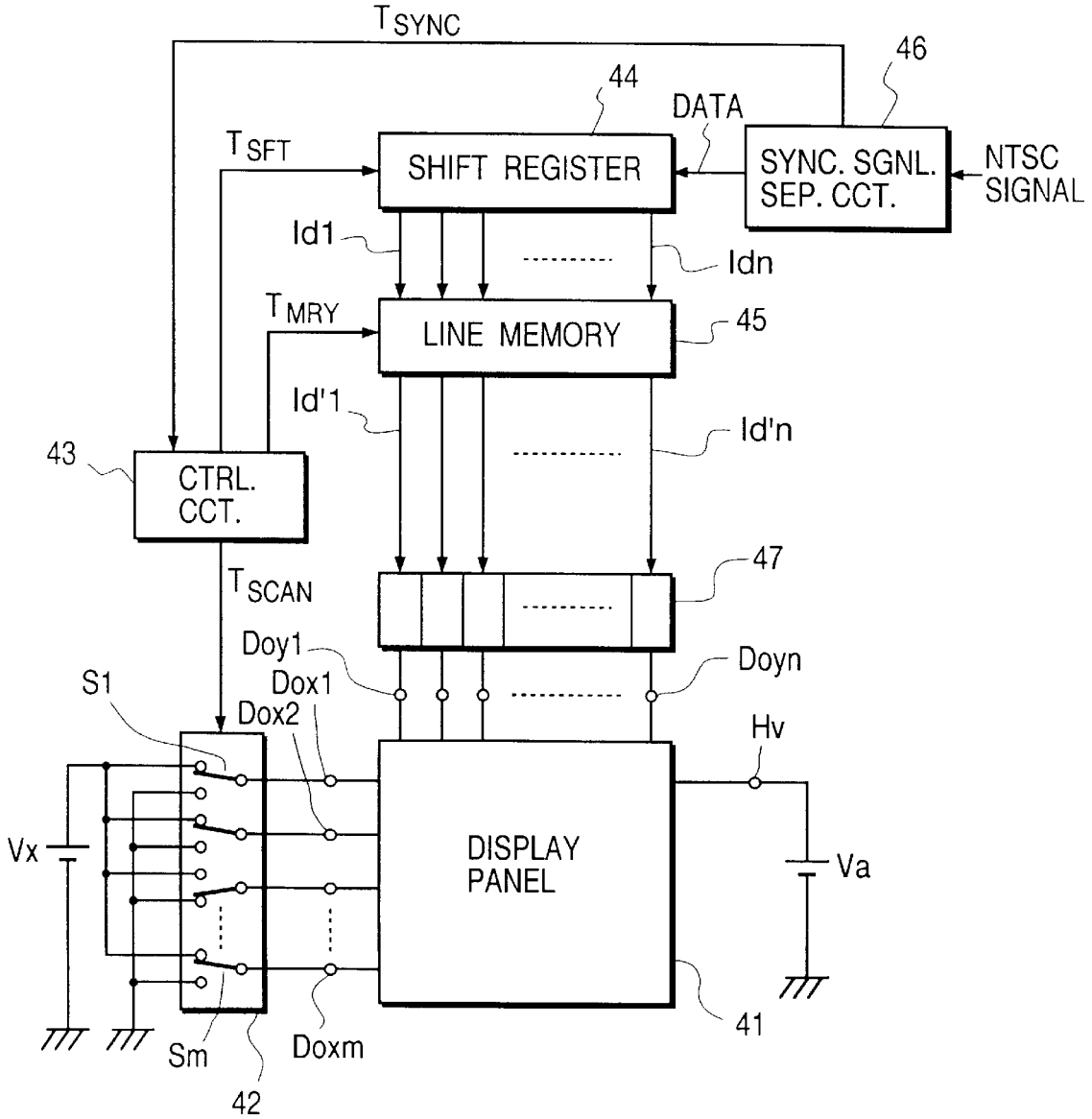
FIG. 12 is a schematic circuit diagram of a drive circuit that can be used for displaying images according to NTSC television signals.

Now, an image-forming apparatus comprising an electron source having a simple matrix arrangement as described above will be described by referring to FIGS. 10, 11A, 11B and 12. FIG. 10 is a partially cut away schematic perspective view of the image forming apparatus and FIGS. 11A and 11B are schematic views, illustrating two possible configurations of a fluorescent film that can be used for the image forming apparatus of FIG. 10, whereas FIG. 12 is a block diagram of a drive circuit for the image forming apparatus of FIG. 10 that operates for NTSC television signals.

Referring firstly to FIG. 10 illustrating the basic configuration of the display panel of the image-forming apparatus, it comprises an electron source substrate 21 of the above described type carrying thereon a plurality of electron-emitting devices, a rear plate 31 rigidly holding the electron source substrate 21, a face plate 36 prepared by laying a fluorescent film 34 and a metal back 35 on the inner surface of a glass substrate 33 and a support frame 32, to which the rear plate 31 and the face plate 36 are bonded by means of frit glass. Reference numeral 37 denote an envelope, which is baked to 400° to 500° C. for more than 10 minutes in the atmosphere or in nitrogen and hermetically and airtightly sealed.

In FIG. 10, reference numeral 24 denotes the electron-emitting devices and reference numerals 22 and 23 respectively denotes the X-directional wire and the Y-directional wire connected to the respective device electrodes of each electron-emitting device.

While the envelope 37 is formed of the face plate 36, the support frame 32 and the rear plate 31 in the above described embodiment, the rear plate 31 may be omitted if the substrate 21 is strong enough by itself because the rear plate 31 is provided mainly for reinforcing the substrate 21. If such is the case, an independent rear plate 31 may not be required and the substrate 31 may be directly bonded to the support frame 32 so that the envelope 37 is constituted of a face plate 36, a support frame 32 and a substrate 21. The overall strength of the envelope 37 may be increased by arranging a number of support members called spacers (not shown) between the face plate 36 and the rear plate 31.

FIGS. 11A and 11B schematically illustrate two possible arrangements of fluorescent film. While the fluorescent film 34 (FIG. 10) comprises only a single fluorescent body if the display panel is used for showing black and white pictures, it needs to comprise for displaying color pictures black conductive members 38 and fluorescent bodies 39, of which the former are referred to as black stripes or members of a black matrix depending on the arrangement of the fluorescent bodies. Black stripes or members of a black matrix are arranged for a color display panel so that the fluorescent bodies 39 of three different primary colors are made less discriminable and the adverse effect of reducing the contrast of displayed images of external light is weakened by blackening the surrounding areas. While graphite is normally used as a principal ingredient of the black stripes, other conductive material having low light transmissivity and reflectivity may alternatively be used.

A precipitation or printing technique is suitably be used for applying a fluorescent material to the glass substrate regardless of black and white or color display. An ordinary metal back 35 is arranged on the inner surface of the fluorescent film 34. The metal back 35 is provided in order to enhance the luminance of the display panel by causing the rays of light emitted from the fluorescent bodies and directed to the inside of the envelope to turn back toward the face plate 36, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum evaporation after forming the fluorescent film.

A transparent electrode (not shown) may be formed on the face plate 36 facing the outer surface of the fluorescent film 34 in order to raise the conductivity of the fluorescent film 34.

Care should be taken accurately to align each set of color fluorescent bodies and an electron-emitting device, if a color display is involved, before the above-listed components of the envelope are bonded together.

Now, a method of manufacturing an image-forming apparatus as illustrated in FIG. 10 will be described below.

Figure 13:
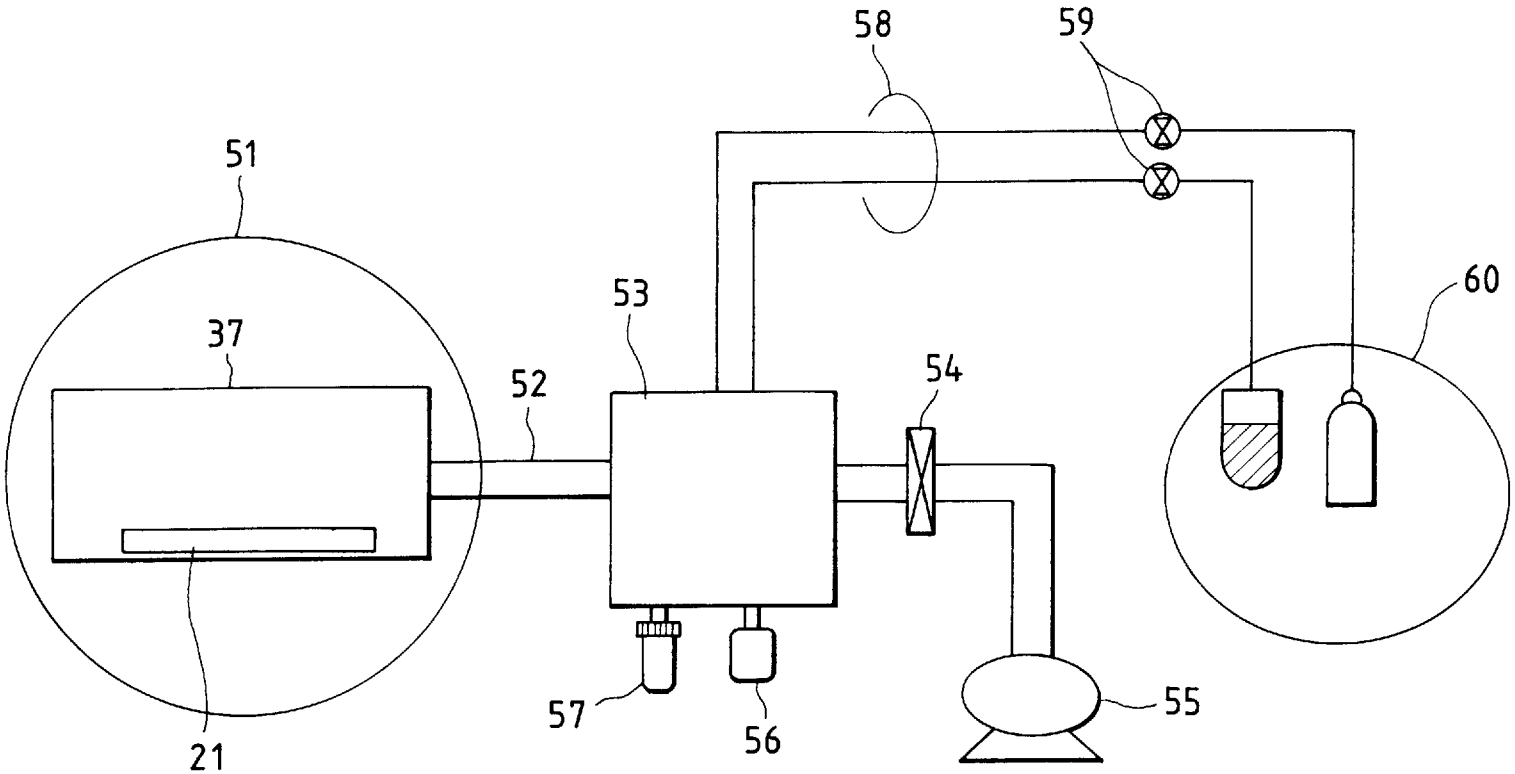
FIG. 13 is a schematic block diagram of a vacuum processing system that can be used for manufacturing an image-forming apparatus for the purpose of the invention.

FIG. 13 shows a schematic block diagram of a vacuum processing system that can be used for manufacturing an image-forming apparatus according to the invention. In FIG. 13, an image-forming apparatus 51 is connected to the vacuum chamber 53 of the vacuum system by way of an exhaust pipe 52. The vacuum chamber 53 is further connected to a vacuum pump unit 55 by way of a gate valve 54. A pressure gauge 56, a quadrupole mass (Q-mass) spectrometer 57 and other instruments are arranged within the vacuum chamber 53 to measure the internal pressure and the partial pressures of the gases within the chamber. Since it is difficult to directly gauge the internal pressure of the envelope 37 of the image-forming apparatus 51, the parameters for the manufacturing operation are controlled by gauging the internal pressure of the vacuum chamber 53 and other measurable factors.

A gas feed line 58 is connected to the vacuum chamber 53 in order to introduce a gaseous substance necessary for the operation and control the atmosphere within the chamber. The gas feed line 58 is, at the other end, connected to a substance source 60, that may be an ampule or a cylinder containing a substance to be supplied to the vacuum chamber. A feeding rate control means 59 is arranged on the gas feed line in order to control the rate at which the substance in the source 60 is fed to the chamber. More specifically, the feeding rate control means may be a slow leak valve that can control the rate of leaking gas or a mass flow controller depending on the type of the substance to be fed.

Figure 14:
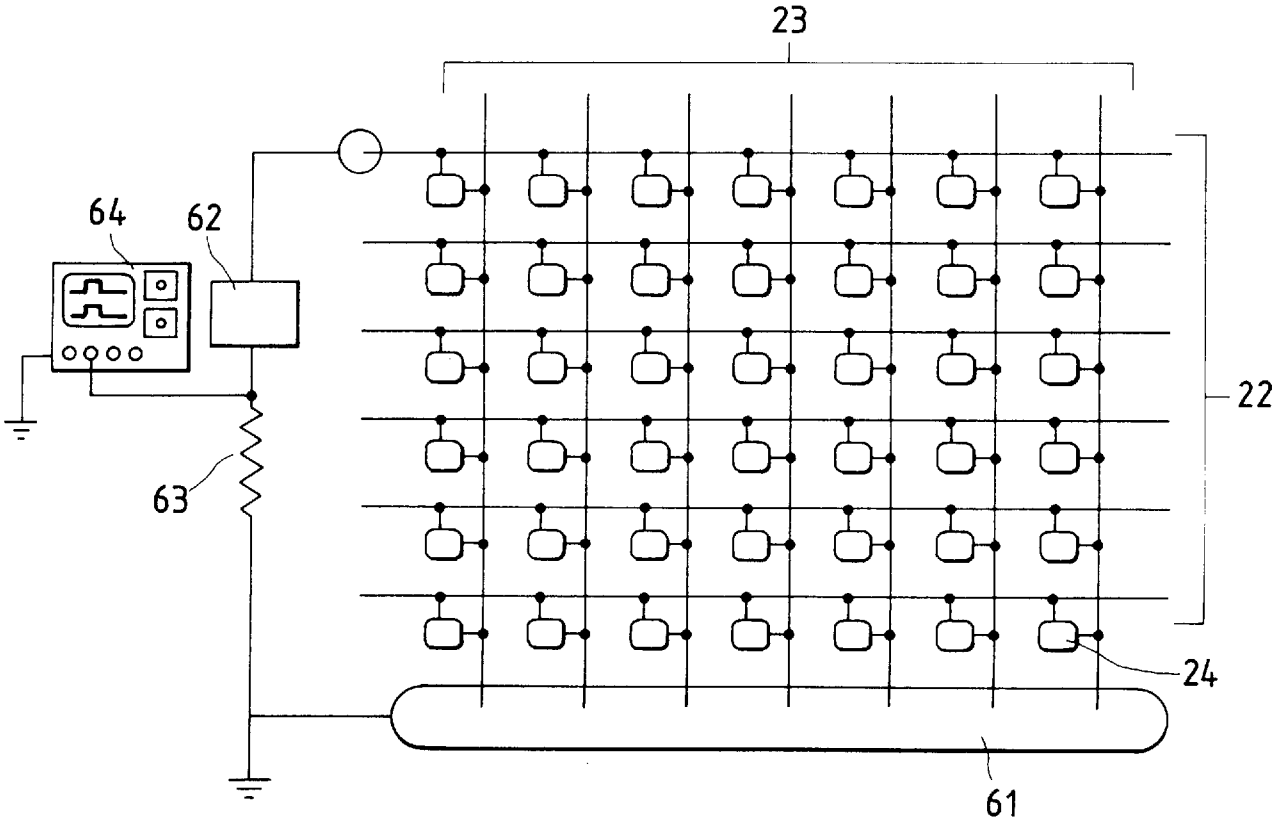
FIG. 14 is a schematic circuit diagram that can be used for carrying out an energization forming process.

After evacuating the inside of the envelope 37 by means of an arrangement as shown in FIG. 13, the image forming apparatus is subjected to a forming process. This process may be carried out by connecting the Y-directional wires 23 to common electrode 61 and applying a pulse voltage to the electron-emitting devices connected to each of the X-directional wires 22 on a wire by wire basis as shown in FIG. 14. The wave form of the pulse voltage to be applied, the conditions under which the process is terminated are other factors concerning the process may be appropriately selected by referring to the above description on the forming process for a single electron-emitting device. In FIG. 13, reference numeral 63 denotes a resistor for gauging an electric current running therethrough and reference numeral 64 denotes an oscilloscope for gauging an electric current.

After the completion of the forming process, an electron-scattering plane forming layer is produced.

In this process of producing an electron-scattering plane forming layer, a source gas selected appropriately depending on the material of the layers to be formed within the envelope is introduced and a pulse voltage is applied to each electron-emitting device by means of CVD. The wiring arrangement used for the forming process may also be used for this process.

If a low work function material layer or a high melting point substance layer is produced on the lower potential side electroconductive thin film after the completion of producing an electron-scattering plane forming layer, an appropriate source gas good for the process is introduced and a pulse voltage as described above is applied. Note, however, that the polarlity of the pulse voltage to be applied is inverted from the one used above.

Note also that at least part of the forming process down to the process of producing a low function material layer or a high melting point substance layer may be carried out before the preparation and hermetical sealing of the envelope.

The envelope 37 is evacuated by means of the vacuum pump unit 55 such as an oil free pump unit consisting of an ion pump and a sorption pump that does not involve the use of oil by way of the exhaust pipe 52, while it is being heated to 80° to 250° C., until the atmosphere in the inside is reduced to a sufficiently low pressure and the organic substances contained therein are satisfactorily eliminated, when the exhaust pipe is heated to melt by a burner and then hermetically sealed. Then, a getter process may be conducted in order to maintain the achieved degree of vacuum in the inside of the envelope 37 after it is sealed. In a getter process, a getter (not shown) arranged at a predetermined position in the envelope 37 is heated by means of a resistance heater or a high frequency heater to form a film by evaporation immediately before or after the envelope 37 is sealed. A getter typically contains Ba as a principal ingredient and can maintain a degree of vacuum within the envelope 37 by the adsorption effect of the film deposited by evaporation.

Now, a drive circuits for driving a display panel comprising an electron source with a simple matrix arrangement for displaying television images according to NTSC television signals will be described by referring to FIG. 12. In FIG. 12, reference numeral 41 denotes a display panel. Otherwise, the circuit comprises a scan circuit 42, a control circuit 43, a shift register 44, a line memory 45, a synchronizing signal separation circuit 46 and a modulation signal generator 47. Vx and Va in FIG. 11 denote DC voltage sources.

The display panel 41 is connected to external circuits via terminals Dox1 through Doxm, Doy1 through Doym and high voltage terminal Hv, of which terminals Dox1 through Doxm are designed to receive scan signals for sequentially driving on a one-by-one basis the rows (of N devices) of an electron source in the apparatus comprising a number of surface-conduction type electron-emitting devices arranged in the form of a matrix having M rows and N columns.

On the other hand, terminals Doy1 through Doyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction type electron-emitting devices. It is an accelerating voltage for giving energy to electron beams emitted from the surface conduction electron-emitting devices at a rate sufficient to energize the fluorescent body of the image-forming apparatus.

The scan circuit 42 operates in a manner as follows. The circuit comprises M switching devices (of which only devices S1 and Sm are specifically indicated in FIG. 13), each of which takes either the output voltage of the DC voltage source Vx or 0[V] (the ground potential level) and comes to be connected with one of the terminals Dox1 through Doxm of the display panel 41. Each of the switching devices S1 through Sm operates in accordance with control signal Tscan fed from the control circuit 43 and can be prepared by combining switching devices such as FETs.

The DC voltage source Vx of this circuit is designed to output a constant voltage such that any drive voltage applied to devices that are not being scanned is reduced to less than threshold voltage due to the performance of the surface conduction electron-emitting devices (or the threshold voltage for electron emission).

The control circuit 43 coordinates the operations of related components so that images may be appropriately displayed in accordance with externally fed video signals. It generates control signals Tscan, Tsft and Tmry in response to synchronizing signal Tsync fed from the synchronizing signal separation circuit 46, which will be described below.

The synchronizing signal separation circuit 46 separates the synchronizing signal component and the luminance signal component from an externally fed NTSC television signal and can be easily realized using a popularly known frequency separation (filter) circuit. Although a synchronizing signal extracted from a television signal by the synchronizing signal separation circuit 46 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 44, is designated as DATA signal.

The shift register 44 carries out for each line a serial/parallel conversion on DATA signals that are serially fed on a time series basis in accordance with control signal Tsft fed from the control circuit 43. (In other words, a control signal Tsft operates as a shift clock for the shift register 44.) A set of data for a line of one image that have undergone a serial/parallel conversion (and correspond to a set of drive data for N electron-emitting devices) are sent out of the shift register 44 as n parallel signals Id1 through Idn.

The line memory 45 is a memory for storing a set of data for a line of one image, which are signals Id1 through Idn, for a required period of time according to control signal Tmry coming from the control circuit 43. The stored data are sent out as Id'1 through Id'n and fed to the modulation signal generator 47.

Said modulation signal generator 47 is in fact a signal source that appropriately drives and modulates the operation of each of the surface-conduction type electron-emitting devices and output signals of this device are fed to the surface-conduction type electron-emitting devices in the display panel 41 via terminals Doy1 through Doyn.

As described above, an electron-emitting device, to which the present invention is applicable, is characterized by the following features in terms of emission current Ie. Firstly, there exists a clear threshold voltage Vth and the device emits electrons only when a voltage exceeding Vth is applied thereto. Secondly, the level of emission current Ie changes as a function of the change in the applied voltage above the threshold level Vth. More specifically, when a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either voltage modulation method or pulse width modulation method may be used for modulating an electron-emitting device in response to an input signal. With voltage modulation, a voltage modulation type circuit is used for the modulation signal generator 47 so that the peak level of the pulse shaped voltage is modulated according to input data, while the pulse width is held constant.

With pulse width modulation, on the other hand, a pulse width modulation type circuit is used for the modulation signal generator 47 so that the pulse width of the applied voltage may be modulated according to input data, while the peak level of the applied voltage is held constant. Although it is not particularly mentioned above, the shift register 44 and the line memory 45 may be either of digital or of analog signal type so long as serial/parallel conversions and storage of video signals are conducted at a given rate.

If digital signal type devices are used, output signal DATA of the synchronizing signal separation circuit 46 needs to be digitized. However, such conversion can be easily carried out by arranging an A/D converter at the output of the synchronizing signal separation circuit 46. It may be needless to say that different circuits may be used for the modulation signal generator 47 depending on if output signals of the line memory 45 are digital signals or analog signals. If digital signals are used, a D/A converter circuit of a known type may be used for the modulation signal generator 47 and an amplifier circuit may additionally be used, if necessary. As for pulse width modulation, the modulation signal generator 47 can be realized by using a circuit that combines a high speed oscillator, a counter for counting the number of waves generated by said oscillator and a comparator for comparing the output of the counter and that of the memory. If necessary, am amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 47 and a level shift circuit may be added thereto if necessary. As for pulse width modulation, a known voltage control type oscillation circuit (VCO) may be used with, if necessary, an additional amplifier to be used for voltage amplification up to the drive voltage of a surface-conduction type electron-emitting device.

With an image forming apparatus having a configuration as described above, to which the present invention is applicable, the electron-emitting devices emit electrons as a voltage is applied thereto by way of the external terminals Dox1 through Doxm and Doy1 through Doyn. Then, the generated electron beams are accelerated by applying a high voltage to the metal back 35 or a transparent electrode (not shown) by way of the high voltage terminal Hv. The accelerated electrons eventually collide with the fluorescent film 34, which in turn glows to produce images.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is also suited for TV signals involving a larger number of scanning lines (typically of a high definition TV system such as the MUSE system).

Now, an electron source comprising a plurality of surface conduction electron-emitting devices arranged in a ladder-like manner on a substrate and an image-forming apparatus comprising such an electron source will be described by referring to FIGS. 15 and 16.

Figure 15:
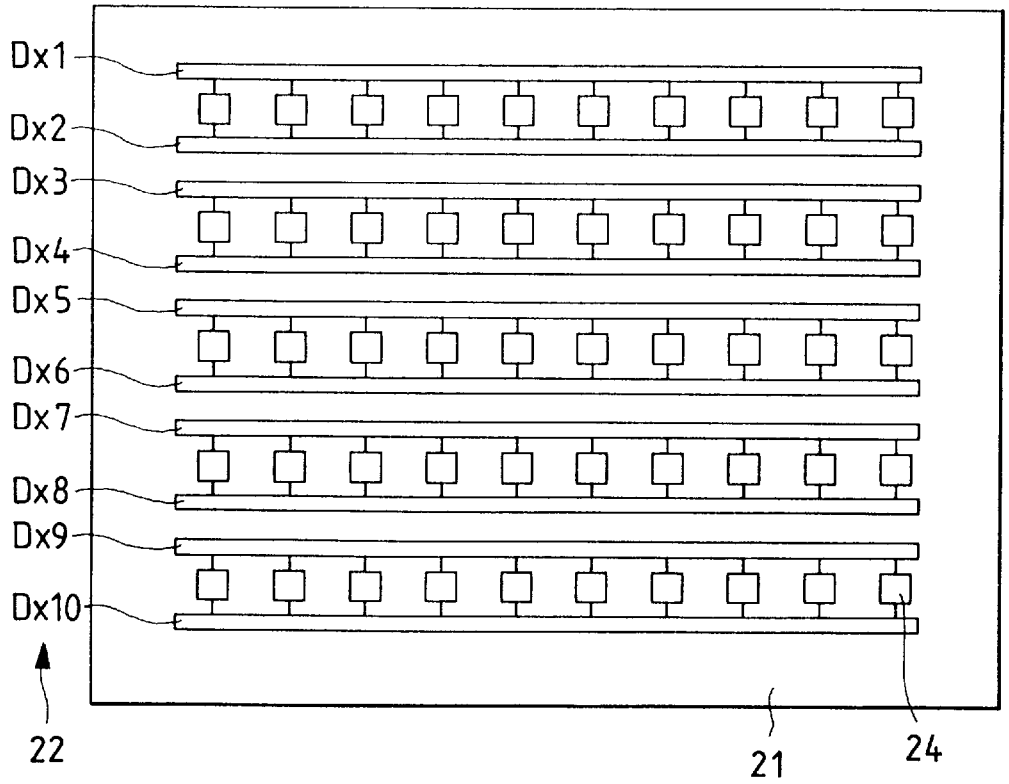
FIG. 15 is a schematic plan view of an electron source having a ladder-like wiring arrangement.

Firstly referring to FIG. 15 schematically showing an electron source having a ladder-like arrangement, reference numeral 21 denotes an electron source substrate and reference numeral 24 denotes a surface conduction electron-emitting device arranged on the substrate, whereas reference numeral 22 denotes (X-directional) wires Dx1 through Dx10 for connecting the surface conduction electron-emitting devices 24. The electron-emitting devices 24 are arranged in rows (to be referred to as device rows hereinafter) on the substrate 21 to form an electron source comprising a plurality of device rows, each row having a plurality of devices. The surface conduction electron-emitting devices of each device row are electrically connected in parallel with each other by a pair of common wires so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wire. Thus, for example, of the common wires Dx2 through Dx9, Dx2 and Dx3 can share a single common wire instead of two wires.

Figure 16:
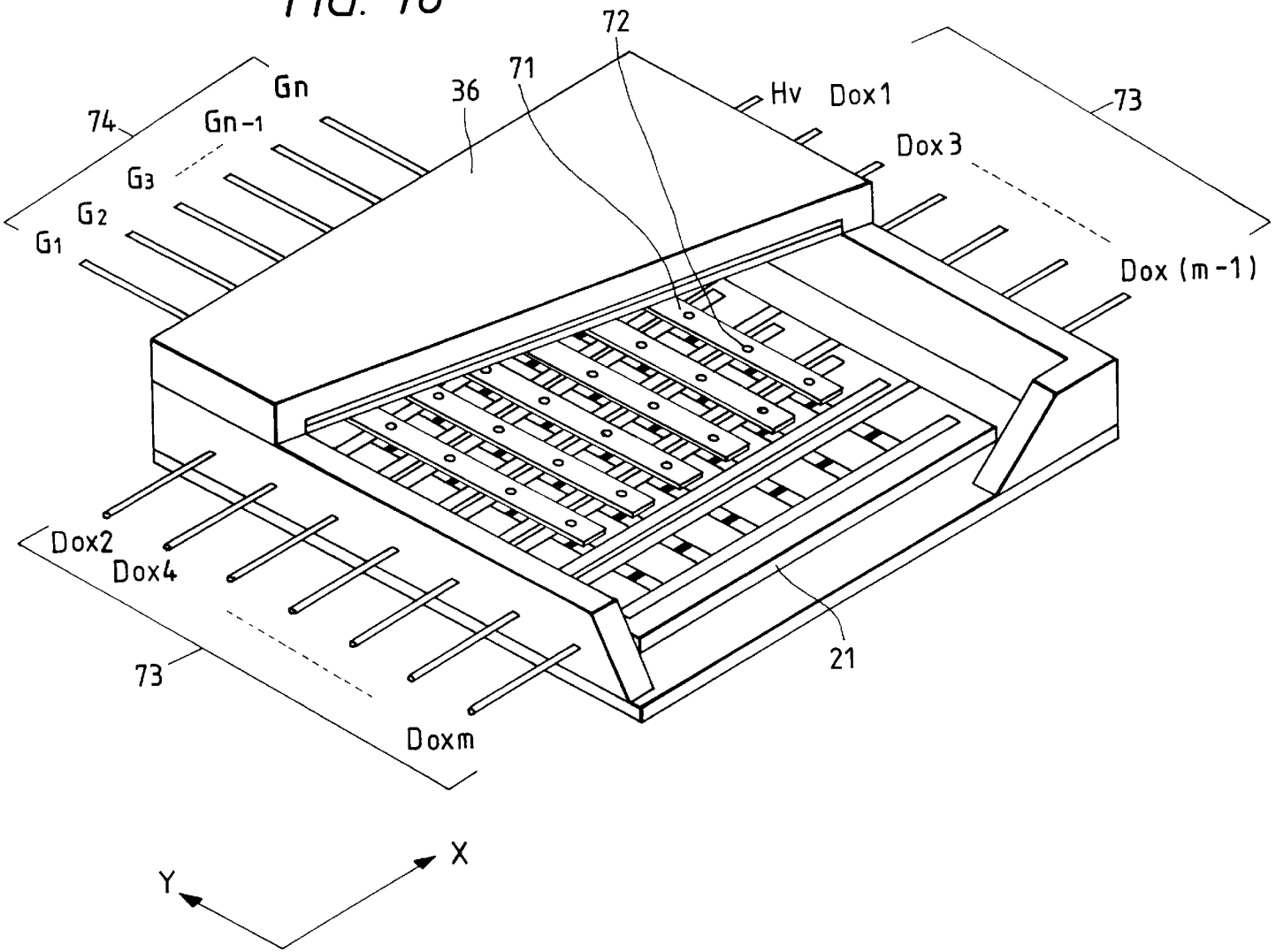
FIG. 16 is a schematic perspective view of an image-forming apparatus comprising an electron source having a ladder-like wiring arrangement.

FIG. 16 is a schematic perspective view of the display panel of an image-forming apparatus incorporating an electron source having a ladder-like arrangement of electron-emitting devices. In FIG. 16, the display panel comprises grid electrodes 71, each provided with a number of bores 72 for allowing electrons to pass therethrough and a set of external terminals 73, or Dox1, Dox2, . . . , Doxm, along with another set of external terminals 74, or G1, G2, . . . , Gn, connected to the respective grid electrodes 71 and an electron source substrate 31. The image forming apparatus differs from the image forming apparatus with a simple matrix arrangement of FIG. 10 mainly in that the apparatus of FIG. 16 has grid electrodes 71 arranged between the electron source substrate 21 and the face plate 36.

In FIG. 16, the stripe-shaped grid electrodes 71 are arranged perpendicularly relative to the ladder-like device rows for modulating electron beams emitted from the surface conduction electron-emitting devices, each provided with through bores 72 in correspondence to respective electron-emitting devices for allowing electron beams to pass therethrough. Note that, however, while stripe-shaped grid electrodes are shown in FIG. 16, the profile and the locations of the electrodes are not limited thereto. For example, they may alternatively be provided with mesh-like openings and arranged around or close to the surface conduction electron-emitting devices.

The external terminals 73 and the external terminals 74 for the grids are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

EXAMPLES

Now, the present invention will be described by way of examples.

Examples 1–3, Comparative Examples 1 and 2

FIG. 17A schematically illustrates the configuration of the surface conduction electron-emitting devices prepared in these examples.

Referring to FIG. 17A, the illustrated device comprises a substrate 1, device electrodes 2 and 3, electroconductive thin films 4 and 5, an electron-scattering plane forming layer 6 and an electron-emitting region 7.

In each of these examples, an electron-scattering plane forming layer 6 has a double-layered configuration of a first layer 81 and a second layer 82 formed on the electroconductive thin film 5.

The process employed for manufacturing each of the electron-emitting devices will be described by referring to FIGS. 18A through 18F.

Figure 18A:
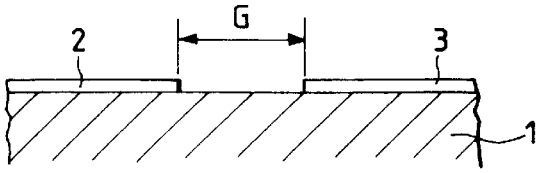
FIGS. 18A through 18F are schematic cross-sectional side views of a surface conduction electron-emitting device that can be used for the purpose of the invention, showing different manufacturing steps.

Step a:

After thoroughly cleansing a soda lime glass substrate 1 by means of a neutral detergent, pure water and an organic solvent, a Ti film and an Ni film were sequentially formed to respective thicknesses of 5 nm and 100 nm by vacuum evaporation. Thereafter, photoresist (AZ1370: available from Hoechst Corporation) was applied and baked to produce a resist layer. Then, using a photomask, it was exposed to light and photochemically developed to produce a pattern for a pair of device electrodes 2 and 3 separated by a distance (gap length) G of 3 $\mu$m and having a length W (See FIG. 1A) of 300 $\mu$m. (FIG. 18A)

Figure 18B:
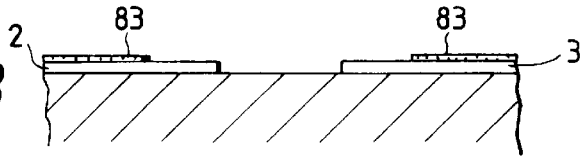

Step b:

A Cr film was formed to a film thickness of 100 nm by vacuum evaporation and then photoresist (RD-2000N-41: available from Hitachi Chemical Co., Ltd.) was applied thereto and baked to form a resist layer. Thereafter, using a photomask, it was exposed to light, photochemically developed and an opening corresponding to the pattern of an electroconductive thin film was formed there. After removal of the Cr film of the areas for the electroconductive thin film by wet etching, the resist layer was removed by dissolving it into acetone to produce a Cr mask 83. (FIG. 18B)

Figure 18C:
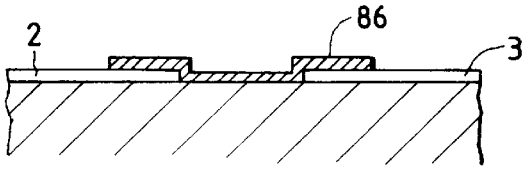

Step c:

A Pd amine complex solution (ccp4230: available from Okuno Pharmaceutical Co., Ltd.) was applied to the Cr mask by means of a spinner and baked at 300° C. for 10 minutes in the atmosphere to produce a PdO fine particle film. Then, the Cr mask 83 was removed by wet-etching and the PdO fine particle film was lifted off to obtain an electroconductive thin film 86 having a desired profile. (FIG. 18C)

Step d:

The device was placed in the vacuum chamber of a vacuum processing system as schematically illustrated in FIG. 7 and the vacuum chamber 16 of the system was evacuated to a pressure of $2.7\times10^{-3}$Pa. Subsequently, a pulse voltage was applied between the device electrodes 2 and 3 to flow an electric current through the electroconductive thin film and thereby carry out an energization forming process.

Figure 6A:
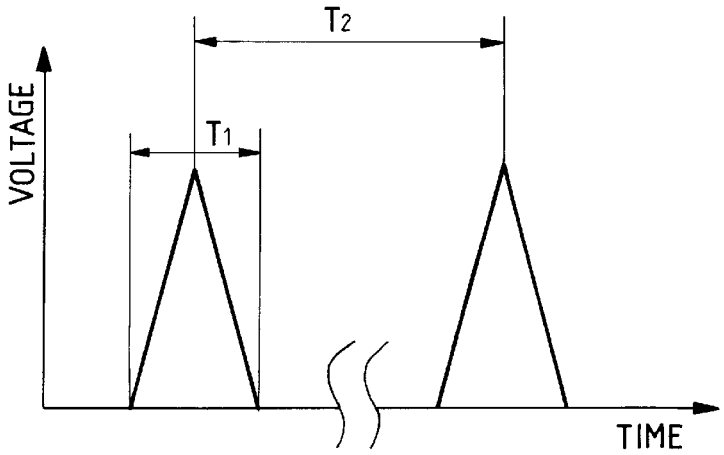
FIGS. 6A and 6C are graphs showing voltage waveforms that can be used for manufacturing and driving an electron-emitting device for the purpose of the invention.
Figure 6B:
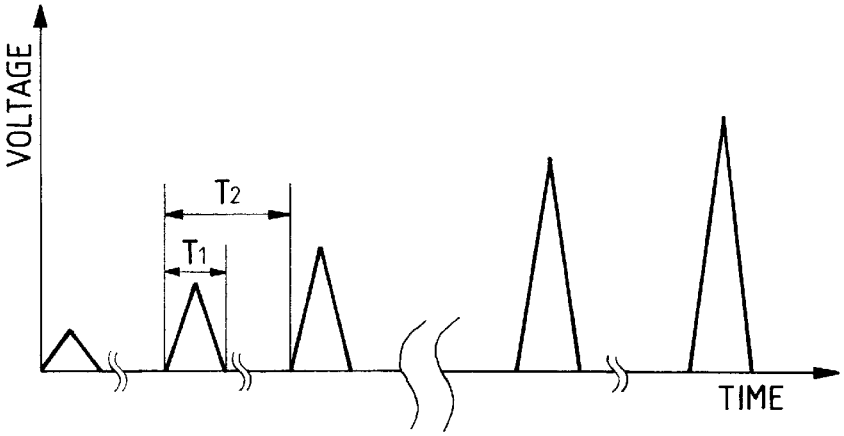
Figure 18D:
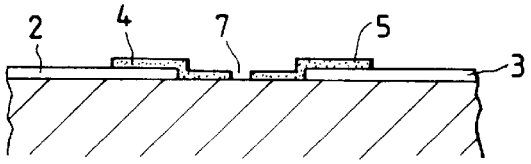

The pulse voltage used for the forming process was a triangular pulse voltage whose peak value gradually increased with time as shown in FIG. 6B. The pulse voltage had a pulse width of T1=1 msec and a pulse interval of T2=10 msec. During the energization forming process, an extra pulse voltage of 0.1 V (not shown) was inserted into intervals of the forming pulse voltage in order to determine the resistance of the electroconductive thin film and the energization forming process was terminated when the resistance exceeded 1 MΩ. As a result, a fissure 7 constituting an electron-emitting region was formed in part of the electroconductive thin film, which was consequently divided into a thin film 4 and another thin film 5. (FIG. 18D)

Step e:

Subsequently, a second layer 82 of an electron-scattering plane forming layer was formed on the electroconductive thin film 5 by MOCVD. Then, the device was heated to 150° C. in the vacuum chamber 16 of FIG. 7. A triangular pulse voltage with a wave height of 16 V, a pulse width of T1=1 msec. and a pulse interval of T2=10 msec. was applied to the device. Then, $La(C_{11}H_{19}O_2)_3$ was introduced into the vacuum chamber 16 as a source gas from the substance source 18 of the system to produce a pressure between $10^{-2}$Pa to several Pa in the vacuum chamber by controlling the valve 19.

Figures 2, 18E:
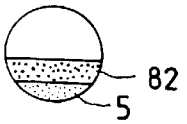
Figures 1, 18E:
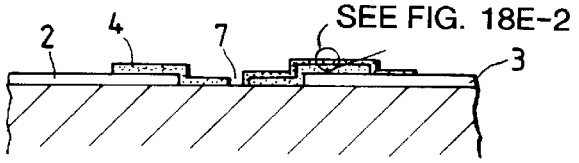

This process was continued for 30 minutes to produce the second layer 82 of the electron-scattering plane forming layer consisting of La. The film thickness was about 70 nm. (FIG. 18E)

Step f:

Thereafter, a first layer 81 of the electron-scattering plane forming layer was produced.

Figures 2, 18F:
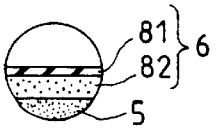
Figures 2, 18F:
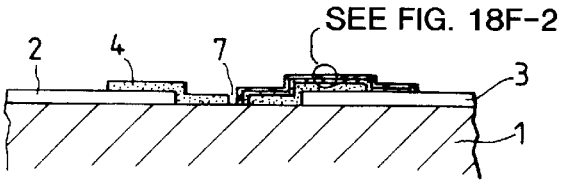

After removing the $La(C_{11}H_{19}O_2)_3$ introduced in the above step and remaining in the vacuum chamber, an identical pulse voltage was applied to the device and $(C_2H_5)_3B$ was introduced into the vacuum chamber to produce the first layer of the electron-scattering plane forming layer consisting of B. (FIG. 18F)

Note that in Examples 1, 2 and 3, the first layers of the electron-scattering plane forming layers of the prepared devices were made equal to 3 nm, 5 nm and 10 nm respectively by appropriately selecting the durations of this step. For the purpose of comparison, the steps up to Step-e of Examples 1, 2 and 3 were followed for and an ordinary activation process was carried out on the device of Comparative Example 1 and, in Step-f, the first layer of electron-scattering plane forming layer was made equal to 20 nm for the device of Comparative Example 2.

Each of the sample devices was then tested for electron-emitting performance by driving it with a gauging system of FIG. 7. A pulse voltage was applied to the device in such a way that the device electrodes 2 and 3 were respectively made to be lower and higher potential side device electrodes (and therefore the electroconductive thin film 4 and the electroconductive thin film 5 on which an electron-scattering plane forming layer 6 had been formed were respectively made to be lower and higher potential side electroconductive thin films). The wave height of the applied pulse voltage was 16 V. The distance H between the device and the anode was 4 mm and the potential difference between them was 1 kV. Table 1 below shows the emission current Ie, the device current If and the electron emission efficiency η observed on each of the sample devices.

After the measurement, each of the devices was observed through a scanning electron microscope (SEM) to find out that, while the electron-scattering plane forming layer of the device of Example 3 had a relatively continuous layered structure, that of the device of Example 1 had a discontinuous structure.

In each of the devices of Examples 1 through 3, it was found that the electron-scattering plane forming layer 6 was extended by a distance of about L=50 $\mu$m (FIG. 17A) from the electron-emitting region 7.

TABLE 1

| device | first film layer thickness (nm) | Ie ($\mu$A) | If (mA) | η (%) |
|---|---|---|---|---|
| Example 1 | 3 | 7.0 | 2.8 | 0.25 |
| Example 2 | 5 | 6.6 | 3.0 | 0.22 |
| Example 3 | 10 | 3.1 | 3.1 | 0.10 |
| Comparative Example 1 | 0 | 1.2 | 2.5 | 0.048 |
| Comparative Example 2 | 20 | 1.2 | 3.0 | 0.04 |

Examples 4 through 6

Figures 2, 17C:
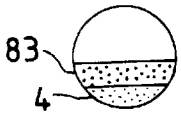
FIG. 17C is a schematic cross-sectional side view of a surface conduction electron-emitting device provided with an electron-scattering plane forming layer having a double-layered configuration on the higher potential side and a low work function material layer on the lower potential side.
Figures 3, 17C:
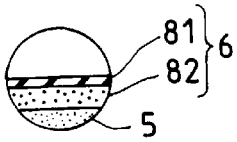
Figures 1, 17C:
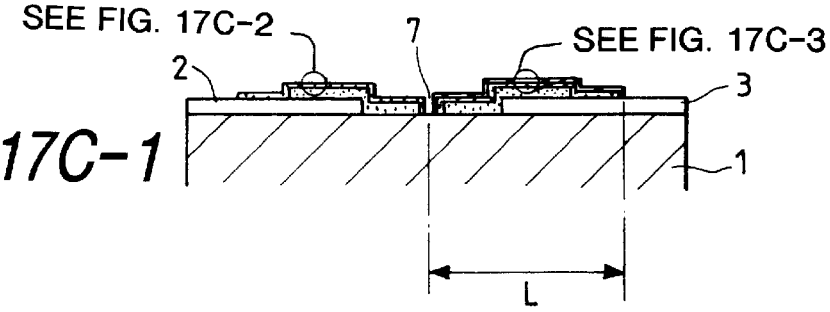

FIG. 17C schematically illustrates the configuration of the surface conduction electron-emitting devices prepared in these examples. In each of these examples, steps a through d, or steps down to the energization forming process, of Example 1 were followed. Thereafter, the following steps were carried out.

Step e:

A pair of La thin films 82 and 83 were formed respectively on the electroconductive thin films 4 and 5 by MOCVD.

Figure 6C:
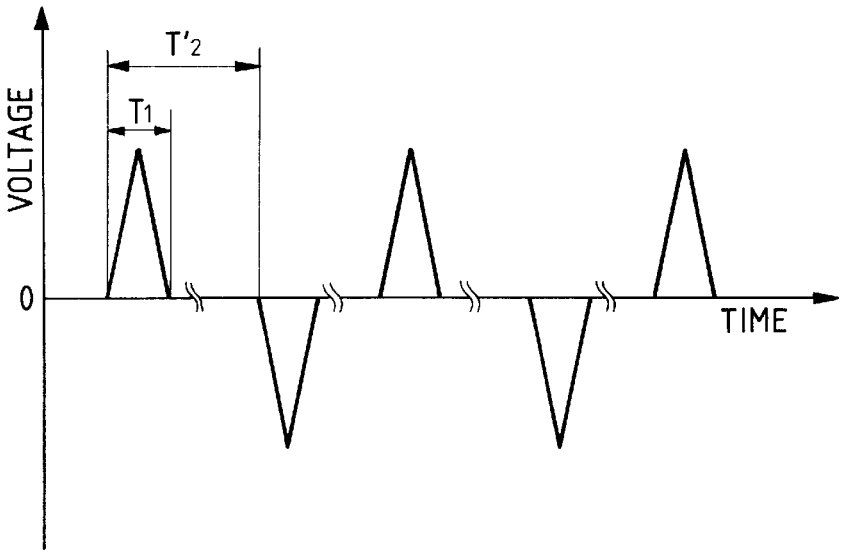

Then, the device was heated to 150° C. in the vacuum chamber 16 of FIG. 7. A triangular pulse voltage having an alternating polarity as shown in FIG. 6C with a wave height of 16 V, a pulse width of T1=1 msec. and a pulse interval of T2=10 msec. was applied to the device. Then, $La(C_{11}H_{19}O_2)_3$ was introduced into the vacuum chamber 16 as a source gas from the substance source 18 of the system to produce a pressure between $10^{-2}$Pa to several Pa in the vacuum chamber by controlling the valve 19.

This process was continued for 30 minutes to produce La thin films respectively on the electroconductive thin films 4 and 5. The film thickness was about 40 nm.

Step f:

Thereafter, a first layer 81 of the electron-scattering plane forming layer consisting of B was produced on one of the electroconductive thin films, or electroconductive thin film 5, as in the case of step f of Example 1.

Note that in Examples 4 through 6, the B layers of the prepared devices were made equal to 3 nm, 5 nm and 10 nm respectively by appropriately selecting the durations of this step.

As in the case of Examples 1 through 3, each of the sample devices was then tested for electron-emitting performance by driving it with a gauging system of FIG. 7. A pulse voltage was applied to the device in such a way that the device electrodes 2 and 3 were respectively made to be lower and higher potential side device electrodes (and therefore the electroconductive thin film 4 on which the La thin film 83 had been formed and the electroconductive thin film 5 on which the electron-scattering plane forming layer 6 constituted of the second layer of La thin film 82 and the first B layer 81 had been formed were respectively made to be lower and higher potential side electroconductive thin films).

In each of the above devices, the La thin film 83 operates as a low work function material layer. Table 2 below shows the performance of each of the sample devices of these examples observed in a test. After the measurement, each of the devices was observed through a scanning electron microscope (SEM) to find out that the electron-scattering plane forming layer 6 was extended by a distance of about L=50 nm (FIG. 17C) from the electron-emitting region 7.

TABLE 2

| device | first film layer thickness (nm) | Ie (μA) | If (mA) | η (%) |
|---|---|---|---|---|
| Example 4 | 3 | 7.4 | 3.1 | 0.24 |
| Example 5 | 5 | 7.4 | 3.2 | 0.23 |
| Example 6 | 10 | 3.3 | 3.0 | 0.11 |

Examples 7 through 12

For each of the devices prepared in these examples, the first layer 81 and the second layer 82 of the electron-scattering plane forming layer 6 were respectively made of Si and La. Otherwise, the manufacturing steps of Examples 1 through 6 were followed. $SiH_4$ was used for the source gas of Si.

Examples 13 through 24

For each of the devices prepared in Examples 13 through 18, the first layer 81 and the second layer 82 of the electron-scattering plane forming layer 6 were respectively made of B and Sc. Otherwise, the manufacturing steps of Examples 1 through 6 were followed. Likewise, for each of the devices prepared in Examples 19 through 24, the first layer 81 and the second layer 82 of the electron-scattering plane forming layer 6 were respectively made of Si and Sc. Otherwise, the manufacturing steps of Examples 1 through 6 were followed. $Sc(C_{11}H_9O_2)_3$ was used for the source gas of Sc.

Examples 25 through 48

For each of the devices prepared in Examples 25 through 30, the first layer 81 and the second layer 82 of the electron-scattering plane forming layer 6 were respectively made of B and Sr. Otherwise, the manufacturing steps of Examples 1 through 6 were followed. $Sr(C_{11}H_{19}O_2)_3$ was used for the source gas of Sr.

Likewise, for each of the devices prepared in Examples 31 through 36, the first layer 81 and the second layer 82 of the electron-scattering plane forming layer 6 were respectively made of Si and Sr. $SiH_4$ was used for the source gas of Si.

Similarly, for each of the devices prepared in Examples 37 through 42, the first layer 81 and the second layer 82 of the electron-scattering plane forming layer 6 were respectively made of B and Ba. $Ba(C_{11}H_{19}O_2)_3$ was used for the source gas of Ba.

In a similar way, for each of the devices prepared in Examples 43 through 48, the first layer 81 and the second layer 82 of the electron-scattering plane forming layer 6 were respectively made of Si and Ba. $SiH_4$ was used for the source gas of Si and $Ba(C_{11}H_{19}O_2)_3$ was used for the source gas of Ba.

Each of the sample devices was then tested for electron-emitting performance by driving it with a gauging system of FIG. 7, using the conditions of Examples 1 through 3. A pulse voltage was applied to the device in such a way that the device electrodes 2 and 3 were respectively made to be lower and higher potential side device electrodes (and therefore the electroconductive thin film 4 and the electroconductive thin film 5 on which an electron-scattering plane forming layer 6 had been formed were respectively made to be lower and higher potential side electroconductive thin films). Table 3 below shows the performance of each of the sample devices of these examples observed in a test.

In Table 3, "type 1" denotes a device having an electron-scattering plane forming layer on the higher potential side and no low work function material layer on the lower potential side (FIG. 17A), whereas "type 2" denotes a device having an electron-scattering plane forming layer on the higher potential side and a low work function material layer on the lower potential side (FIG. 17C).

After the measurement, each of the devices was observed through a scanning electron microscope (SEM) to find out that the electron-scattering plane forming layer 6 was extended by a distance of about L=50 nm from the electron-emitting region 7.

TABLE 3

| device Example | type | #1 layer material | #1 layer thickness (nm) | #2 layer material | Ie (μA) | If (mA) | η (%) |
|---|---|---|---|---|---|---|---|
| 7 | 1 | Si | 3 | La | 5.1 | 2.7 | 0.19 |
| 8 | 1 | Si | 5 | La | 4.8 | 2.8 | 0.17 |
| 9 | 1 | Si | 10 | La | 2.9 | 2.9 | 0.10 |
| 10 | 2 | Si | 3 | La | 6.0 | 3.0 | 0.20 |
| 11 | 2 | Si | 5 | La | 5.1 | 3.0 | 0.17 |
| 12 | 2 | Si | 10 | La | 3.2 | 3.2 | 0.10 |

TABLE 3-continued

| device Example | type | #1 layer material | #1 layer thickness (nm) | #2 layer material | Ie (μA) | If (mA) | η (%) |
|---|---|---|---|---|---|---|---|
| 13 | 1 | B | 3 | Sc | 5.4 | 2.7 | 0.20 |
| 14 | 1 | B | 5 | Sc | 4.6 | 2.7 | 0.17 |
| 15 | 1 | B | 10 | Sc | 2.8 | 2.8 | 0.10 |
| 16 | 2 | B | 3 | Sc | 5.1 | 3.0 | 0.17 |
| 17 | 2 | B | 5 | Sc | 4.5 | 3.0 | 0.15 |
| 18 | 2 | B | 10 | Sc | 2.8 | 3.1 | 0.09 |
| 19 | 1 | Si | 3 | Sc | 3.5 | 2.7 | 0.13 |
| 20 | 1 | Si | 5 | Sc | 3.5 | 2.7 | 0.13 |
| 21 | 1 | Si | 10 | Sc | 3.0 | 2.8 | 0.11 |
| 22 | 2 | Si | 3 | Sc | 3.7 | 2.7 | 0.14 |
| 23 | 2 | Si | 5 | Sc | 2.9 | 2.7 | 0.12 |
| 24 | 2 | Si | 10 | Sc | 2.4 | 2.8 | 0.085 |
| 25 | 1 | B | 3 | Sr | 6.8 | 2.7 | 0.25 |
| 26 | 1 | B | 5 | Sr | 5.9 | 2.7 | 0.22 |
| 27 | 1 | B | 10 | Sr | 2.8 | 2.8 | 0.10 |
| 28 | 2 | B | 3 | Sr | 7.8 | 2.9 | 0.27 |
| 29 | 2 | B | 5 | Sr | 5.9 | 2.8 | 0.22 |
| 30 | 2 | B | 10 | Sr | 3.0 | 2.8 | 0.11 |
| 31 | 1 | Si | 3 | Sr | 5.1 | 2.7 | 0.19 |
| 32 | 1 | Si | 5 | Sr | 3.9 | 2.6 | 0.15 |
| 33 | 1 | Si | 10 | Sr | 2.5 | 2.7 | 0.093 |
| 34 | 2 | Si | 3 | Sr | 5.2 | 2.9 | 0.18 |
| 35 | 2 | Si | 5 | Sr | 4.3 | 2.5 | 0.17 |
| 36 | 2 | Si | 10 | Sr | 2.8 | 2.7 | 0.10 |
| 37 | 1 | B | 3 | Ba | 7.8 | 2.9 | 0.27 |
| 38 | 1 | B | 5 | Ba | 7.0 | 2.8 | 0.25 |
| 39 | 1 | B | 10 | Ba | 3.1 | 3.2 | 0.097 |
| 40 | 2 | B | 3 | Ba | 9.0 | 3.2 | 0.28 |
| 41 | 2 | B | 5 | Ba | 7.4 | 3.1 | 0.24 |
| 42 | 2 | B | 10 | Ba | 3.3 | 3.2 | 0.10 |
| 43 | 1 | Si | 3 | Ba | 6.4 | 2.9 | 0.22 |
| 44 | 1 | Si | 5 | Ba | 5.1 | 2.7 | 0.19 |
| 45 | 1 | Si | 10 | Ba | 3.0 | 3.0 | 0.10 |
| 46 | 2 | Si | 3 | Ba | 6.5 | 3.1 | 0.21 |
| 47 | 2 | Si | 5 | Ba | 5.2 | 2.9 | 0.18 |
| 48 | 2 | Si | 10 | Ba | 3.1 | 3.1 | 0.10 |

Examples 49 through 51, Comparative Examples 3 through 5

FIG. 17B schematically illustrates the configuration of the surface conduction electron-emitting devices prepared in these examples.

In each of the sample devices prepared in these examples, the electron-scattering plane forming layer 6 had a single-layered configuration.

The surface conduction electron-emitting devices of these examples were prepared in a manner as described below.

For each of the devices prepared in these examples, steps a through c of Example 1 were followed. The subsequent steps will be described by referring to FIGS. 20D through 20F.

Figure 20D:
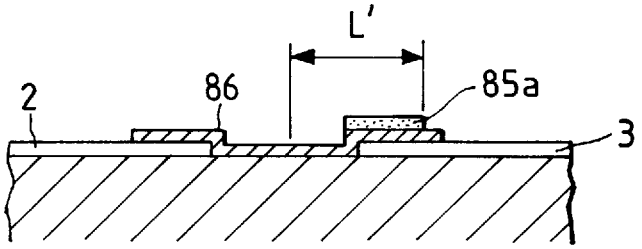
FIGS. 20D through 20F are schematic cross-sectional side views of a surface conduction electron-emitting device having a different configuration, showing different manufacturing steps.

Step d:

A thin film 85*a* of B was formed by high frequency sputtering on the part of the electroconductive thin film 86 located on the device electrode 3. The thickness of the formed film was about 3 nm. For this step, the device was covered by a metal mask to make the distance L' between the outer edge of the B thin film 85*a* and the center of the gap separating the device electrodes (which was substantially equal to the length L of the electron-scattering plane forming layer to be prepared) equal to a desired value. (FIG. 20D)

Figure 20E:
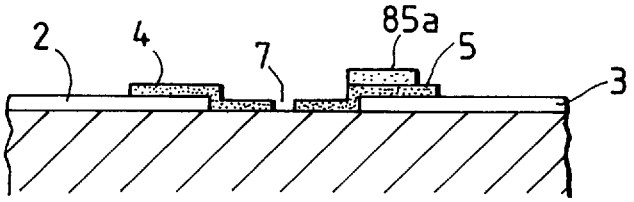
Figure 20F:
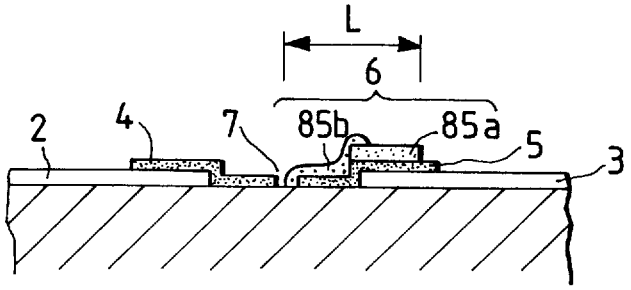

Step e:

The device was put in the vacuum chamber of a vacuum processing system as illustrated in FIG. 7 and subjected to a forming treatment similar to step d of Example 1 to produce an electron-emitting region 7. (FIG. 20E)

Step f:

As in step e of Example 1, another B thin film 85*b* was formed between the electron-emitting region 7 and the B thin film 85*a* by deposition. A pulse voltage was applied to the device for 10 minutes before terminating this step. The period of 10 minutes was the time predetermined to deposit B to a thickness of 3 to 5 nm at a position between the electron-emitting region and the B thin film 85*a* formed in step d. While additional B might have been deposited on part of the B thin film 85*a* formed in step d, the overall thickness of the B thin film 85*a* did not exceed 6 nm at any position thereof.

With the above steps, an electron-scattering plane forming layer 6 having an intended length of L was produced. Note that the devices of these examples were made different in the length L from each other.

Also note that step d was omitted and an electron-scattering plane forming layer of B was produced only by means of Step-f for the device of Comparative Example 3.

Each of the sample devices was then tested for electron-emitting performance by driving it with a gauging system of FIG. 7. The distance between the device and the anode was equal to H=4 mm and the electric potential of the anode relative to the device was equal to Va=1 kV. The pulse voltage applied to the device had a rectangular waveform with a pulse wave height of 16 V, a pulse width of T1=1.0 msec. and a pulse interval of T2=16.7 msec. The pulse voltage was applied to the device in such a way that the device electrodes 2 and 3 were respectively made to be lower and higher potential side device electrodes (and therefore the electroconductive thin film 5 on which the electron-scattering plane forming layer 6 had been formed was made to be a higher potential side electroconductive thin film).

Table 4 below shows the performance of each of the sample devices of these examples observed in a test.

TABLE 4

| device | L (μm) | Ie (μA) | If (mA) | η (%) |
|---|---|---|---|---|
| Comparative Example 3 | 2 | 0.25 | 0.25 | 0.10 |
| Comparative Example 4 | 7 | 0.30 | 0.25 | 0.12 |
| Comparative Example 5 | 12 | 0.38 | 0.25 | 0.15 |
| Example 49 | 22 | 0.50 | 0.25 | 0.20 |
| Example 50 | 32 | 0.55 | 0.25 | 0.22 |
| Example 51 | 42 | 0.58 | 0.25 | 0.23 |

After the measurement, each of the devices was observed through a scanning electron microscope (SEM) to see the length L of the electron-scattering plane forming layer 6. For each of the devices, the right side of formula (1) was about 20 μm. Note that the devices of Examples 49 through 51 showed a remarkable improvement in the electron-emitting efficiency η(%) as compared with those of Comparative Examples 3 through 5 having a value less than 20 μm for L.

Example 52

Figure 19:
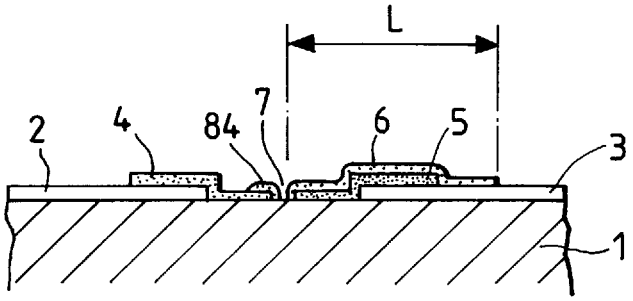
FIG. 19 is a schematic cross-sectional side view of a surface conduction electron-emitting device having a different configuration that can be used for the purpose of the invention.

FIG. 19 schematically illustrates a cross sectional view of the surface conduction electron-emitting device prepared in this example.

The surface conduction electron-emitting device of this example was prepared by following steps a through f of Example 1 and subsequently carrying out step g as described below.

Step g:

The vacuum chamber 16 was evacuated again and then $W(CO)_6$ was introduced, controlling the partial pressure thereof to get to $1.3\times10^{-1}$Pa. Subsequently, a pulse voltage used in Step-f of Example 1 but having an inverted polarity was applied to the device for 5 minutes to cause W to be deposited near the electron-emitting region 7 on the electroconductive thin film 4 to produce a high melting point substance layer 84.

Then, the device was tested for electron-emitting performance by means of the gauging system of Example 1.

The pulse voltage was applied to the device in such a way that the device electrodes 2 and 3 were respectively made to be lower and higher potential side device electrodes (and therefore the electroconductive thin film 5 on which the electron-scattering plane forming layer 6 had been formed was made to be a higher potential side electroconductive thin film).

The device of the example showed values of Ie=6.2 $\mu$A, If=2.5 mA and $\eta$=0.25%. While the value of Ie of the device was a little smaller than that of the device of Example 1, the both devices showed a substantially same electron-emitting efficiency.

Thereafter, the devices of this example and Example 1 were driven for electron emission and the emission current of each of the devices was observed to check its change with time. As a result, it was found that the emission current of this device fell less with time than the than that of the device of Example 1.

It may be safe to assume that the lower potential side electroconductive thin film 2 of the device of this examples was less deformed by Joule's heat and other causes in an area near the electron-emitting region because of the existence of a high melting point substance.

After the measurement, the device was observed through a scanning electron microscope (SEM) to find out that the electron-scattering plane forming layer 6 was extended by a distance of about L=50 nm (FIG. 19) from the electron-emitting region 7.

Example 53

In this example, an electron source was prepared by arranging a large number of electron-emitting devices like those formed in the preceding examples and wiring them with a matrix of wires. The electron source comprised 300 devices on each row along the X-direction and 100 devices on each column along the Y-direction.

Figure 21:
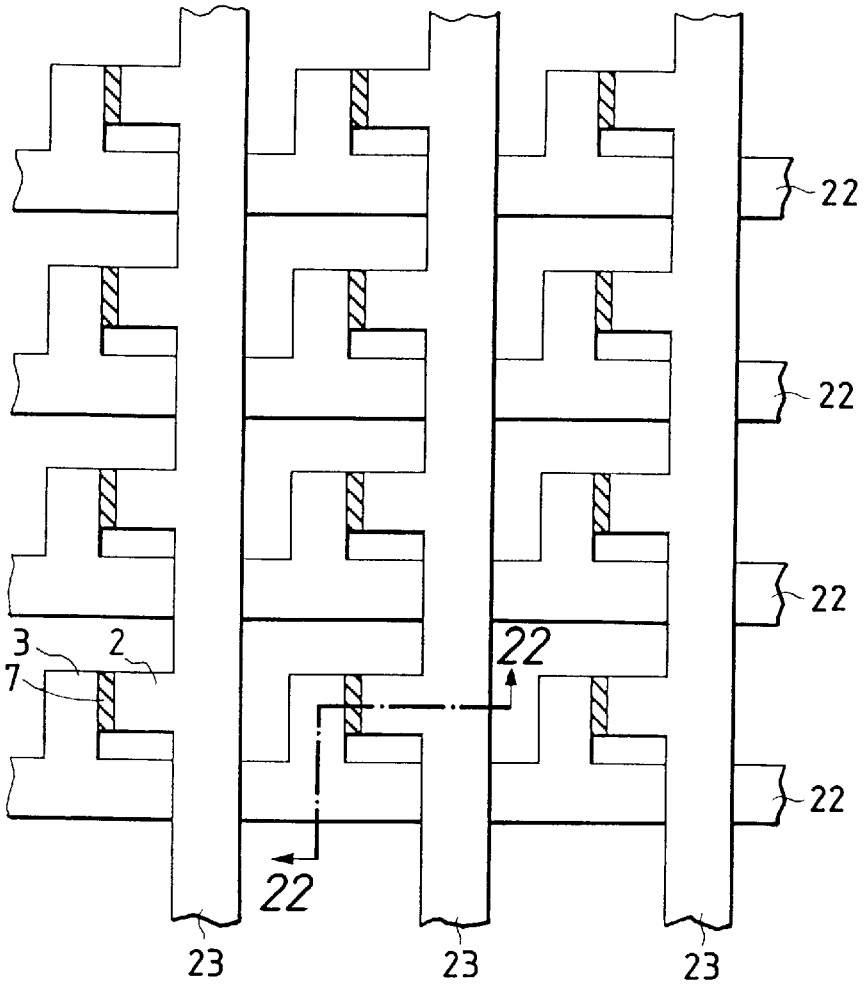
FIG. 21 is a schematic partial plan view of an electron source that can be used for the purpose of the invention.
Figure 22:
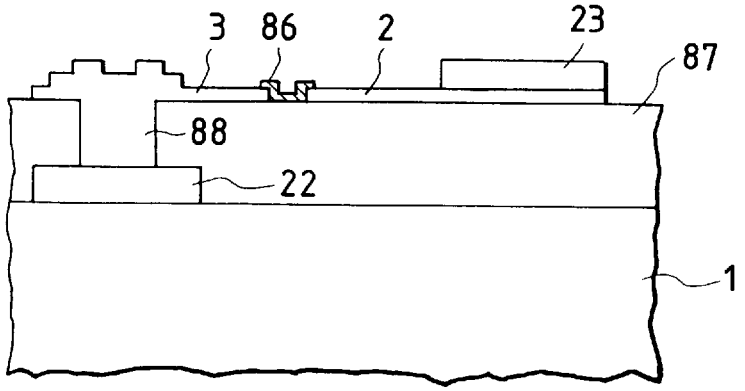
FIG. 22 is a schematic partial cross-sectional view of the electron source of FIG. 21 taken along line 22—22.
Figure 23A:
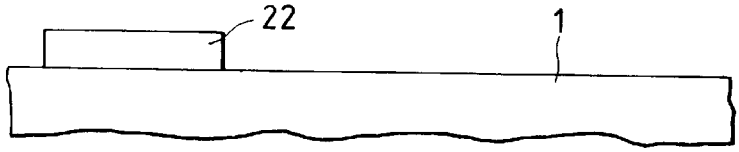
FIGS. 23A through 23H are schematic partial cross-sectional views of an electron source having a matrix wiring arrangement that can be used for the purpose of the invention, showing different manufacturing steps.
Figure 23B:
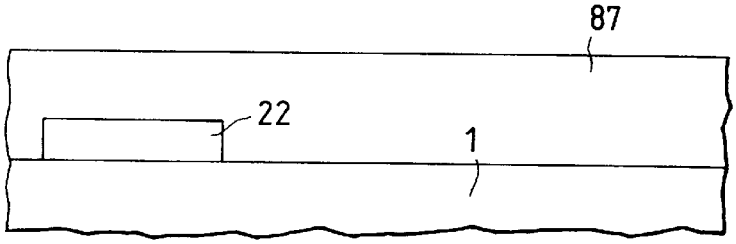
Figure 23C:
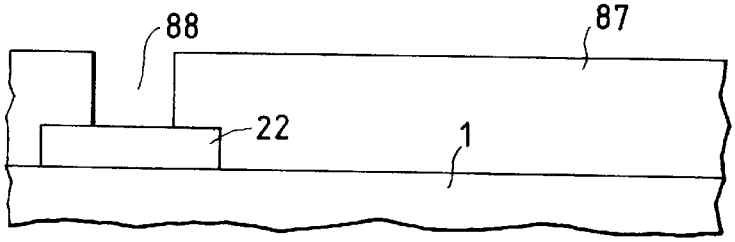
Figure 23D:
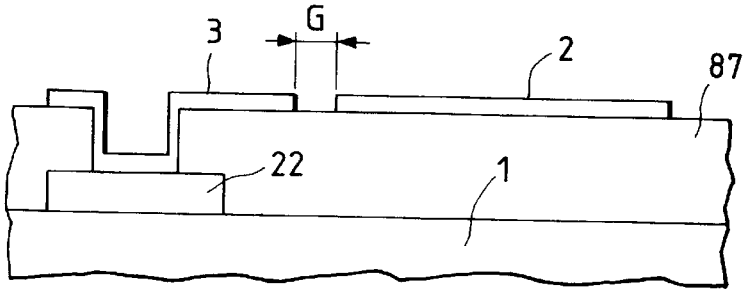
Figure 23E:
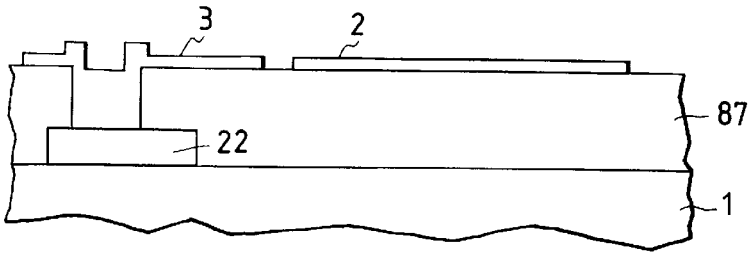
Figure 23F:
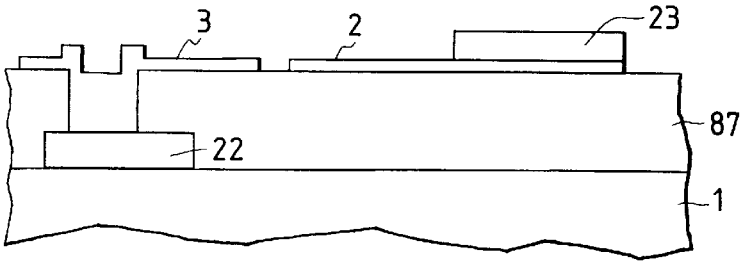
Figure 23G:
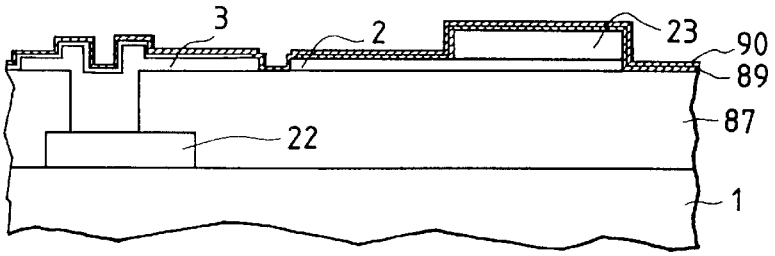
Figure 23H:
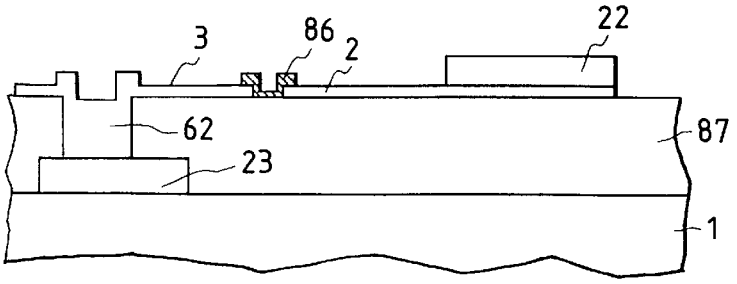

FIG. 21 is an enlarged schematic plan view of part of the electron source of this example. FIG. 22 is a schematic sectional view of the electron source taken along line 22—22 in FIG. 21.

In these figures, reference numeral 1 denotes a substrate and reference numerals 22 and 23 respectively denote an X-directional wire (lower wire) and a Y-directional wire (upper wire), while reference numerals 2 and 3 denote device electrodes and reference numeral 86 denotes an electron-emitting thin film prepared by a patterning operation. For simplification, the lower potential side electroconductive thin film, the higher potential side electroconductive thin film, the electron-emitting region and the electron-scattering plane forming layer are collectively shown. Reference numeral 87 denotes an interlayer insulation layer and reference numeral 88 denotes a contact hole for electrically connecting a device electrode 3 and a lower wire 22.

Now, the method used for manufacturing the image-forming apparatus will be described in terms of an electron-emitting device thereof by referring to FIGS. 23A through 23H. Note that the following manufacturing steps, or step A through step H, respectively correspond to FIGS. 23A. through 23H.

Step A:

After thoroughly cleansing a soda lime glass plate a silicon oxide film was formed thereon to a thickness of 0.5 $\mu$m by sputtering to produce a substrate 1, on which Cr and Au were sequentially laid to thicknesses of 5 nm and 600 nm respectively and then a photoresist (AZ1370: available from Hoechst Corporation) was formed thereon by means of a spinner, while rotating the film, and baked. Thereafter, a photo-mask image was exposed to light and photochemically developed to produce a resist pattern for X-directional wires (lower wires) and then the deposited Au/Cr film was wet-etched to actually produce X-directional wires (lower wires) 22 having a desired profile.

Step B:

A silicon oxide film was formed as an interlayer insulation layer 87 to a thickness of 1.0 $\mu$m by RF sputtering.

Step C:

A photoresist pattern was prepared for producing a contact hole 88 in the silicon oxide film deposited in Step B, which contact hole 88 was then actually formed by etching the interlayer insulation layer 87, using the photoresist pattern for a mask. A technique of RIE (Reactive Ion Etching) using $CF_4$ and $H_2$ gas was employed for the etching operation.

Step D:

Thereafter, a pattern of photoresist (RD-2000N-41: available from Hitachi Chemical Co., Ltd.) was formed for a pair of device electrodes 2 and 3 and a gap G separating the electrodes and then Ti and Ni were sequentially deposited thereon respectively to thicknesses of 5 nm and 100 nm by vacuum evaporation. The photoresist pattern was dissolved into an organic solvent and the Ni/Ti deposit film was treated by using a lift-off technique to produce a pair of device electrodes 2 and 3 having a width of W1=300 $\mu$m and separated from each other by a gap distance of G=3 $\mu$m.

Step E:

A resist pattern was prepared for the entire area except the contact hole 88 and Ti and Au were sequentially deposited by vacuum evaporation to respective thicknesses of 5 nm and 500 nm. The contact hole was buried by removing the unnecessary areas by means of a lift-off technique.

Step F:

After forming a photoresist pattern for Y-directional wires (upper wires), Ti and Au were sequentially deposited by vacuum evaporation to respective thicknesses of 5 nm and 500 nm and then unnecessary areas were removed by means of a lift-off technique to actually produce Y-directional wires (upper wires) 23 having a desired profile.

Step G:

Then, a Cr film 89 was formed to a film thickness of 30 nm by vacuum evaporation and processed to show a pattern having an opening corresponding to the profile of the electroconductive thin film 86. A solution of Pd amine complex (ccp4230) was applied to the Cr film by means of a spinner and baked at 300° C. for 12 minutes to produce an electroconductive thin film 90 made of PdO fine particles and having a film thickness of 70 nm.

Step H:

The Cr film 89 was removed along with any unnecessary portions of the electroconductive thin film 90 of PdO fine particles by wet etching, using an etchant to produce an electroconductive thin film 86 having a desired profile. The electroconductive thin film showed an electric resistance of $Rs=4\times10^4\Omega/\square$ in average.

Step I:

This step and the subsequent steps will be described by referring to FIGS. 10 and 11A.

After securing an electron source substrate 21 onto a rear plate 31, a face plate 36 (carrying a fluorescent film 34 and a metal back 35 on the inner surface of a glass substrate 33) was arranged 5 mm above the substrate 21 with a support frame 32 disposed therebetween and, subsequently, frit glass was applied to the contact areas of the face plate 36, the support frame 32 and the rear plate 31 and baked at 400° C. in the atmosphere for 10 minutes to hermetically seal the container. The substrate 21 was also secured to the rear plate 31 by means of frit glass.

While the fluorescent film 34 is consisted only of a fluorescent body if the apparatus is for black and white images, the fluorescent film 34 of this example as shown in FIG. 11A was prepared by forming black stripes 38 in the first place and filling the gaps with stripe-shaped fluorescent members 39 of primary colors. The black stripes were made of a popular material containing graphite as a principal ingredient. A slurry technique was used for applying fluorescent materials onto the glass substrate 33.

A metal back 35 is arranged on the inner surface of the fluorescent film 34. After preparing the fluorescent film, the metal back 35 was prepared by carrying out a smoothing operation (normally referred to as "filming") on the inner surface of the fluorescent film and thereafter forming thereon an aluminum layer by vacuum evaporation.

While a transparent electrode might be arranged on the outer surface of the fluorescent film 34 of the face plate 36 in order to enhance its electroconductivity, it was not used in this example because the fluorescent film showed a sufficient degree of electroconductivity by using only a metal back.

For the above bonding operation, the components were carefully aligned in order to ensure an accurate positional correspondence between the color fluorescent members and the electron-emitting devices.

Figure 24:
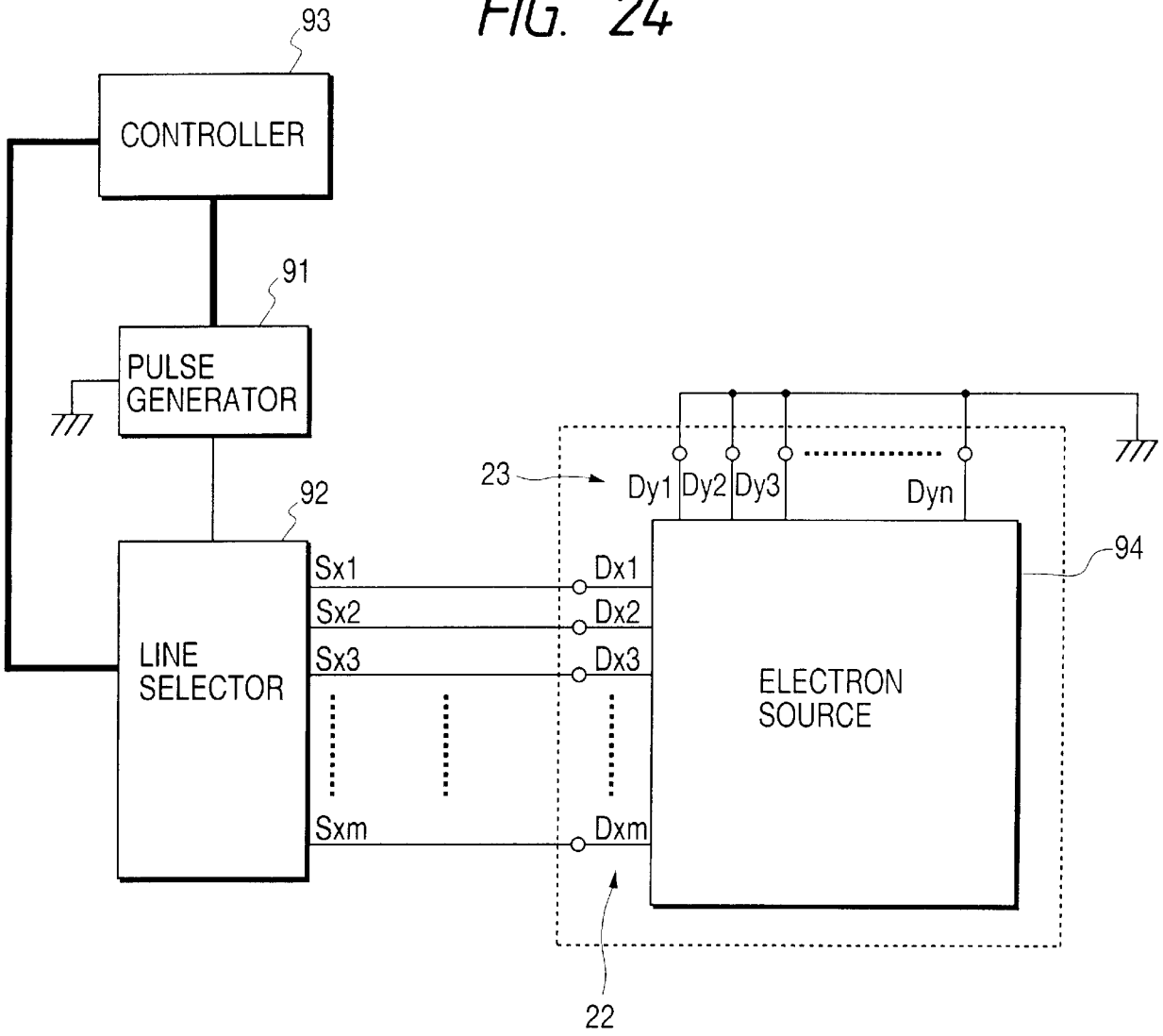
FIG. 24 is a schematic block diagram of a circuit used in an energization forming process for an electron source and an image-forming apparatus incorporating such an electron source that can be used for the purpose of the invention.

Step J:

The image forming apparatus was then placed in a vacuum processing system shown in FIG. 13 and the vacuum chamber 53 was evacuated to reduced the internal pressure to less than $2.6\times10^{-3}$Pa. FIG. 24 shows a diagram of the wiring arrangement used for the forming operation in this example. Referring to FIG. 24, a pulse generated by a pulse generator 91 is applied to one of the X-directional wires 22 selected by a line selector. Both the pulse generator and the line selector are controlled for operation by a control unit 93. The Y-directional wires 23 of the electron source 94 are connected together and grounded. The thick solid line in FIG. 24 represents a control line, whereas thin solid lines represent so many wires. The applied pulse voltage had a triangular pulse wave form with an increasing wave height as shown in FIG. 6B. As in the case of Example 1, a rectangular pulse voltage having a wave height of 0.1 V was inserted into intervals of the triangular pulse to gauge the resistance of each device row and the forming operation was terminated for the row when the resistance exceeded 3.3 kΩ for each device row (or 1 MΩ for each device). Then, the voltage applying line was switched to a next line by the line selector. The pulse wave height was about 7.0 V for all the lines when the forming operation was terminated.

Step K:

$La(C_{11}H_{19}O_2)_3$ was introduced into the vacuum chamber until the internal pressure was raised to $1.3\times10^{-1}$Pa. The same wiring arrangement as in step J was also used to apply a pulse voltage to each of the electron-emitting devices. The pulse wave generated by the pulse generator was a rectangular pulse having a pulse wave height of 18 V, a pulse width of 100 μsec. and a pulse interval of 167 μsec. In other words, the pulse voltage applied to the X-directional wires and having a pulse width of T1=100 μsec. and a pulse interval of T2=16.7 μsec. (or 60 Hz in terms of frequency) was switched sequentially on a wire by wire basis by the line selector for every 167 μsec. The pulse generator and the line selector were driven to operate synchronously under the control of a control unit.

As a result of this step, a second La layer of the electron-scattering plane forming layer was produced on the higher potential side electroconductive thin film by deposition.

Step L:

The envelope was once evacuated and, thereafter, $(C_2H_5)_3B$ was introduced into the envelope and a pulse voltage same as the one used in Step K was applied to each device to produce a first B layer of the electron-scattering plane forming layer.

The envelope was evacuated again to reduce the internal pressure to about $10^{-5}$Pa, while heating the entire panel to about 80° C., and the exhaust pipe (not shown) was heated to melt by a gas burner and hermetically seal the envelope. Finally, the getter (not shown) arranged in the envelope was heated by high frequency heating to carry out a getter process.

The image-forming apparatus produced after the above steps was then driven to operate by applying a scan signal and a modulation signal from a signal generator (not shown) to the electron-emitting devices by way of external terminals Dx1 through Dxm and Dy1 through Dyn so that 14 V was applied to the selected devices, which consequently emitted electrons. The emitted electron beams were accelerated by applying a high voltage greater than 5 kV to the metal back 35 by way of the high voltage terminal Hv to make them collide with the fluorescent film 34, which was consequently excited and fluoresced to display images.

Thereafter, the image-forming apparatus was broken apart and the devices were taken out and observed through a scanning electron microscope (SEM) to find out that, in each device, the first layer (B thin film) of the electron-scattering plane forming layer had a film thickness between 5 and 10 nm and was extended by a distance of about L=10 to 20 μm.

Figure 25:
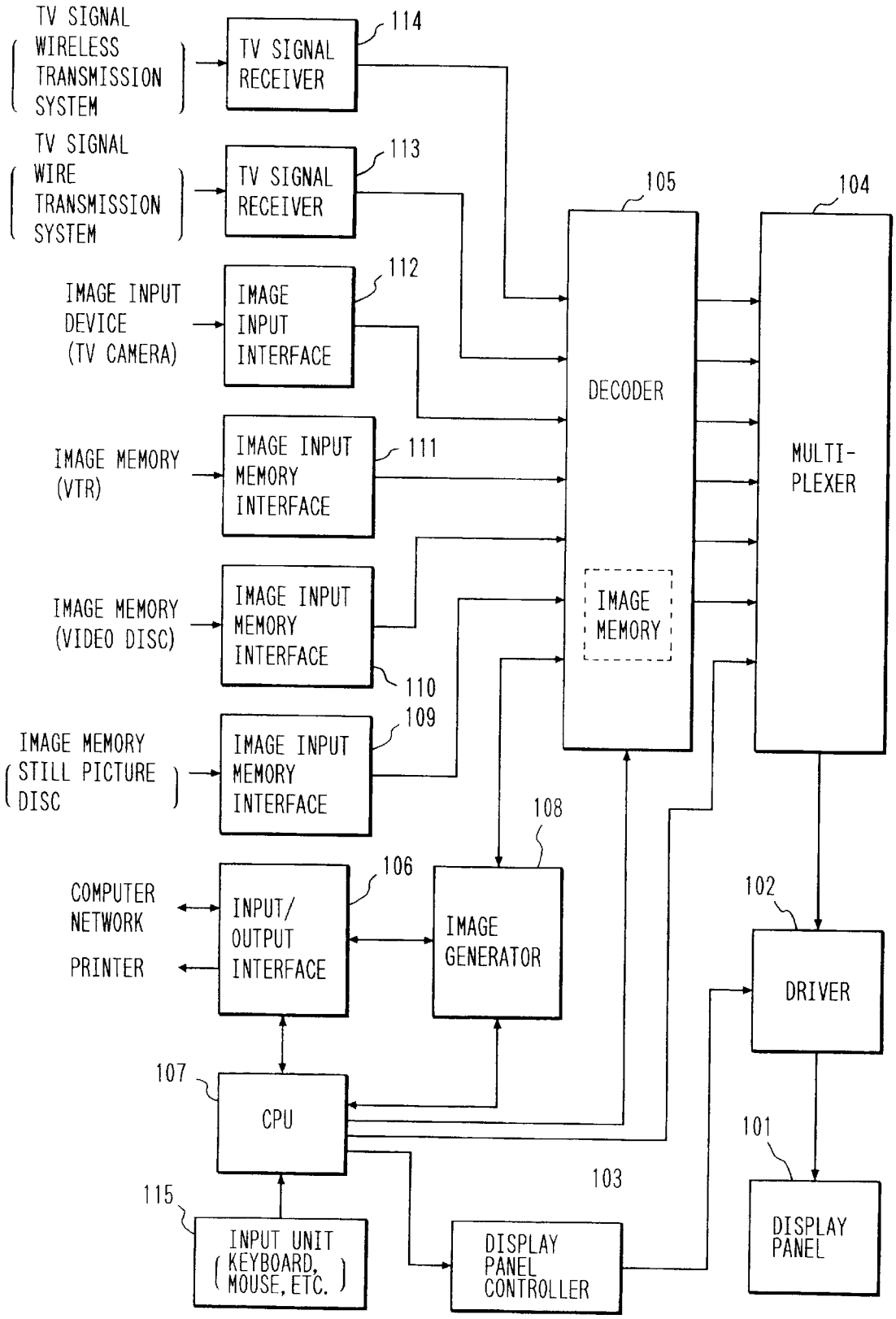
FIG. 25 is a schematic block diagram of an image display system realized by using an image-forming apparatus according to the invention.
Figure 26:
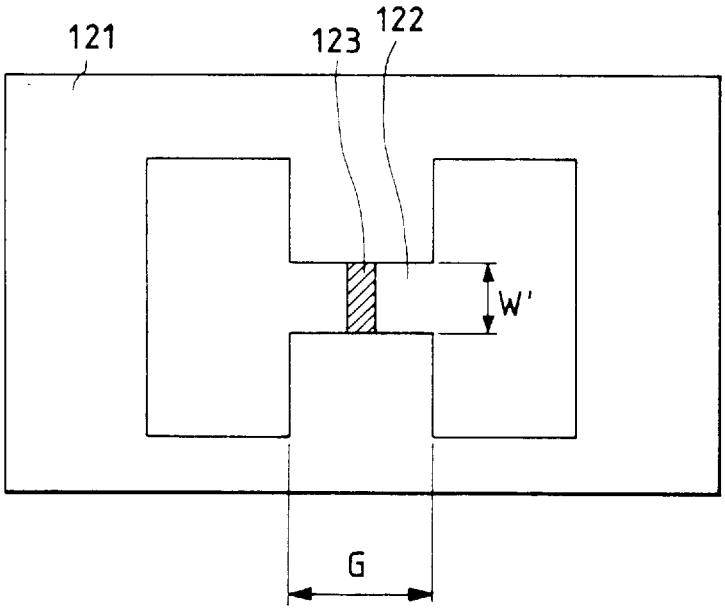
FIG. 26 PRIOR ART
FIG. 26 is a schematic plan view of a device according to M. Hartwell's design.

FIG. 25 is a block diagram of a display apparatus realized by using a method according to the invention and a display panel prepared in Example 11 and arranged to provide visual information coming from a variety of sources of information including television transmission and other image sources.

In FIG. 25, there are shown a display panel 101, a display panel driver 102, a display panel controller 103, a multiplexer 104, a decoder 105, an input/output interface circuit 106, a CPU 107, an image generator 108, image input memory interface circuits 109, 110 and 111, an image input interface circuit 112, TV signal receivers 113 and 114 and an input unit 115. (If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.)

Now, the components of the apparatus will be described, following the flow of image signals therethrough.

Firstly, the TV signal receiver 114 is a circuit for receiving TV image signals transmitted via a wireless transmission system using electromagnetic waves and/or spatial optical telecommunication networks. The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel 101 comprising a large number of pixels. The TV signals received by the TV signal receiver 114 are forwarded to the decoder 105.

The TV signal receiver 113 is a circuit for receiving TV image signals transmitted via a wired transmission system using coaxial cables and/or optical fibers. Like the TV signal receiver 114, the TV signal system to be used is not limited to a particular one and the TV signals received by the circuit are forwarded to the decoder 105.

The image input interface circuit 112 is a circuit for receiving image signals forwarded from an image input device such as a TV camera or an image pick-up scanner. It also forwards the received image signals to the decoder 105.

The image input memory interface circuit 111 is a circuit for retrieving image signals stored in a video tape recorder (hereinafter referred to as VTR) and the retrieved image signals are also forwarded to the decoder 105.

The image input memory interface circuit 110 is a circuit for retrieving image signals stored in a video disc and the retrieved image signals are also forwarded to the decoder 105.

The image input memory interface circuit 109 is a circuit for retrieving image signals stored in a device for storing still image data such as so-called still disc and the retrieved image signals are also forwarded to the decoder 105.

The input/output interface circuit 106 is a circuit for connecting the display apparatus and an external output signal source such as a computer, a computer network or a printer. It carries out input/output operations for image data and data on characters and graphics and, if appropriate, for control signals and numerical data between the CPU 107 of the display apparatus and an external output signal source.

The image generation circuit 108 is a circuit for generating image data to be displayed on the display screen on the basis of the image data and the data on characters and graphics input from an external output signal source via the input/output interface circuit 106 or those coming from the CPU 107. The circuit comprises reloadable memories for storing image data and data on characters and graphics, read-only memories for storing image patterns corresponding to given character codes, a processor for processing image data and other circuit components necessary for the generation of screen images.

Image data generated by the image generation circuit 108 for display are sent to the decoder 105 and, if appropriate, they may also be sent to an external circuit such as a computer network or a printer via the input/output interface circuit 106.

The CPU 107 controls the display apparatus and carries out the operation of generating, selecting and editing images to be displayed on the display screen.

For example, the CPU 107 sends control signals to the multiplexer 104 and appropriately selects or combines signals for images to be displayed on the display screen. At the same time it generates control signals for the display panel controller 103 and controls the operation of the display apparatus in terms of image display frequency, scanning method (e.g., interlaced scanning or non-interlaced scanning), the number of scanning lines per frame and so on.

The CPU 107 also sends out image data and data on characters and graphic directly to the image generation circuit 108 and accesses external computers and memories via the input/output interface circuit 106 to obtain external image data and data on characters and graphics. The CPU 107 may additionally be so designed as to participate other operations of the display apparatus including the operation of generating and processing data like the CPU of a personal computer or a word processor. The CPU 107 may also be connected to an external computer network via the input/output interface circuit 106 to carry out computations and other operations, cooperating therewith.

The input unit 115 is used for forwarding the instructions, programs and data given to it by the operator to the CPU 107. As a matter of fact, it may be selected from a variety of input devices such as keyboards, mice, joysticks, bar code readers and voice recognition devices as well as any combinations thereof.

The decoder 105 is a circuit for converting various image signals input via said circuits 108 through 114 back into signals for three primary colors, luminance signals and I and Q signals. Preferably, the decoder 105 comprises image memories as indicated by a dotted line in FIG. 25 for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 105 in cooperation with the image generation circuit 108 and the CPU 107.

The multiplexer 104 is used to appropriately select images to be displayed on the display screen according to control signals given by the CPU 107. In other words, the multiplexer 104 selects certain converted image signals coming from the decoder 105 and sends them to the drive circuit 102. It can also divide the display screen in a plurality of frames to display different images simultaneously by switching from a set of image signals to a different set of image signals within the time period for displaying a single frame.

The display panel controller 103 is a circuit for controlling the operation of the drive circuit 102 according to control signals transmitted from the CPU 107.

Among others, it operates to transmit signals to the drive circuit 102 for controlling the sequence of operations of the power source (not shown) for driving the display panel in order to define the basic operation of the display panel. It also transmits signals to the drive circuit 102 for controlling the image display frequency and the scanning method (e.g., interlaced scanning or non-interlaced scanning) in order to define the mode of driving the display panel.

If appropriate, the display panel controller 103 transmits control signals for controlling the quality of the image being displayed in terms of brightness, contrast, color tone and/or sharpness of the image to the drive circuit 102.

The drive circuit 102 is a circuit for generating drive signals to be applied to the display panel 101. It operates according to image signals coming from said multiplexer 104 and control signals coming from the display panel controller 103.

A display apparatus according to the invention and having a configuration as described above and illustrated in FIG. 25 can display on the display panel 101 various images given from a variety of image data sources. More specifically, image signals such as television image signals are converted back by the decoder 105 and then selected by the multiplexer 104 before sent to the drive circuit 102. On the other hand, the display controller 103 generates control signals for controlling the operation of the drive circuit 102 according to the image signals for the images to be displayed on the display panel 101. The drive circuit 102 then applies drive signals to the display panel 101 according to the image signals and the control signals. Thus, images are displayed on the display panel 101. All the above described operations are controlled by the CPU 107 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 105, the image generation circuit 108 and the CPU 107 participate such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 25 shows only an example of possible configuration of a display apparatus comprising a display panel provided with an electron source prepared by arranging a number of surface conduction electron-emitting devices and the present invention is not limited thereto. For example, some of the circuit components of FIG. 25 that are not necessary fo for a particular application may be omitted. To the contrary, additional components may be arranged there depending on the application. For example, if a display apparatus according to the invention is used for visual telephone, it may be appropriately made to comprise additional components such as a television camera, a microphone, lighting equipment and transmission/reception circuits including a modem.

As described above in detail, by arranging an electron-scattering plane that elastically scatters incident electrons and has a length L defined by formula (1) above on the higher potential side electroconductive thin film of a surface conduction electron-emitting device at a depth of less than 10 nm from the surface, the electron-emitting efficiency of the device can be remarkably improved. Additionally, by arranging a low work function material layer on the lower potential side electroconductive thin film at a position close to the electron-emitting region, the emission current of the device can be improved or, by arranging a high melting point substance layer, the reduction of the emission current can be suppressed.

What is claimed is:

1. An electron beam apparatus comprising an electron-emitting device, an anode, means for applying a voltage Vf (V) to said electron-emitting device and means for applying another voltage Va (V) to said anode, said electron-emitting device and said anode being separated by a distance H (m), wherein said electron-emitting device has an electron-emitting region arranged between a lower potential side electroconductive thin film connected to a lower potential side electrode and a higher potential side electroconductive thin film connected to a higher potential side electrode and also has a film containing a semiconductor substance and having a thickness not greater than 10 nm, said semiconductor-containing film extending on said higher potential side electroconductive thin film from said electron-emitting region toward said higher potential side electrode over a length L (m) satisfying the relationship expressed by formula (1) below:

$$L \geqq \frac{1}{\pi} \quad \frac{Vf}{Va} H. \tag{1}$$

2. An electron beam apparatus according to claim 1, wherein said film containing a semiconductor substance is arranged on the surface of a film of a material different from the semiconductor substance disposed on the surface of said higher potential side electroconductive thin film.

3. An electron beam apparatus according to claim 2, wherein said different material contains as a principal ingredient an element of the II*a* or III*b* group of the periodic table.

4. An electron beam apparatus according to claim 2, wherein said semiconductor substance contains Si or B and said different material contains at least one of Sr, Ba, Sc and La.

5. An electron beam apparatus according to claim 1, wherein said film containing a semiconductor substance is disposed directly on the surface of said higher potential side electroconductive thin film.

6. An electron beam apparatus according to claim 5, wherein said semiconductor substance contains Si or B.

7. An electron beam apparatus according to claim 1, wherein said film containing a semiconductor substance forms an electron-scattering plane.

8. An electron beam apparatus according to claim 7, wherein said film containing a semiconductor substance is arranged on the surface of a film of a material different from the semiconductor substance disposed on the surface of said higher potential side electroconductive thin film and said electron-scattering plane is formed on the boundary plane of said semiconductor substance and said different material.

9. An electron beam apparatus according to claim 8, wherein said different material contains as a principal ingredient an element of the II*a* or III*b* group of the periodic table.

10. An electron beam apparatus according to claim 8, wherein said semiconductor substance contains Si or B and said different material contains at least one of Sr, Ba, Sc and La.

11. An electron beam apparatus according to claim 7, wherein said film containing a semiconductor substance is disposed directly on the surface of said higher potential side electroconductive thin film and said electron-scattering plane is formed on the boundary plane of said semiconductor substance and said higher potential side electroconductive thin film.

12. An electron beam apparatus according to claim 11, wherein said semiconductor substance contains Si or B.

13. An electron beam apparatus according to claim 1, wherein said electron-emitting device further comprises on said lower potential side electroconductive thin film at least in the vicinity of the electron-emitting region a layer of a substance having a work function lower than that of the material of said lower potential side electroconductive thin film.

14. An electron beam apparatus according to claim 1, wherein said electron-emitting device further comprises on said lower potential side electroconductive thin film at least in the vicinity of the electron-emitting region a layer of a substance having a melting point higher than that of the material of said lower potential side electroconductive thin film.

15. An electron beam apparatus according to claim 14, wherein said high melting point material contains at least one of Nb, Mo, Ru, Hf, Ta, W, Re, Os, Ir, Zr and Rh.

16. An electron beam apparatus according to any of claims 1 through 15, wherein it comprises a plurality of electron-emitting devices arranged on the substrate.

17. An electron beam apparatus according to claim 16, wherein said plurality of electron-emitting devices are wired by a plurality of row-directional wires and a plurality of column-directional wires to form a matrix wiring arrangement.

18. An electron beam apparatus according to claim 16, wherein said plurality of electron-emitting devices are arranged in a ladder-like manner.

19. An electron beam apparatus according to any of claims 1 through 15, wherein it further comprises an image-forming member to be irradiated by electron beams emitted from said electron-emitting devices to produce images.

20. An electron beam apparatus according to claim 19, wherein said plurality of electron-emitting devices are arranged on the substrate.

21. An electron beam apparatus according to claim 20, wherein said plurality of electron-emitting devices are wired by a plurality of row-directional wires and a plurality of column-directional wires to form a matrix wiring arrangement.

22. An electron beam apparatus according to claim 20, wherein said plurality of electron-emitting devices are arranged in a ladder-like manner.

23. A method of driving an electron beam apparatus comprising an electron-emitting device having an electron-emitting region arranged between a lower potential side electroconductive thin film connected to a lower potential side electrode and a higher potential side electroconductive thin film connected to a higher potential side electrode and also having a film containing a semiconductor substance and having a thickness not greater than 10 nm, said semiconductor-containing film extending on said higher potential side electroconductive thin film from said electron-emitting region toward said higher potential side electrode over a length L (m), and an anode disposed as separated from said electron-emitting device by a distance H (m), wherein electron beam apparatus is driven in such a way that voltage Vf (V) applied to said electron-emitting device and voltage Va (V) applied to said anode satisfies the relationship expressed by formula (1) below:

$$L \geq \frac{1}{\pi} \frac{Vf}{Va} H. \quad (1)$$

24. A method of driving an electron beam apparatus according to claim 23, wherein said film containing a semiconductor substance is arranged on the surface of a film of a material different from the semiconductor substance disposed on the surface of said higher potential side electroconductive thin film.

25. A method of driving an electron beam apparatus according to claim 24, wherein said different material contains as a principal ingredient an element of the II*a* or III*b* group of the periodic table.

26. A method of driving an electron beam apparatus according to claim 24, wherein said semiconductor substance contains Si or B and said different material contains at least one of Sr, Ba, Sc and La.

27. A method of driving an electron beam apparatus according to claim 23, wherein said film containing a semiconductor substance is disposed directly on the surface of said higher potential side electroconductive thin film.

28. A method of driving an electron beam apparatus according to claim 27, wherein said semiconductor substance contains Si or B.

29. A method of driving an electron beam apparatus according to claim 23, wherein said film containing a semiconductor substance forms an electron-scattering plane.

30. A method of driving an electron beam apparatus according to claim 29, wherein said film containing a semiconductor substance is arranged on the surface of a film of a material different from the semiconductor substance disposed on the surface of said higher potential side electroconductive thin film and said electron-scattering plane is formed on the boundary plane of said semiconductor substance and said different material.

31. A method of driving an electron beam apparatus according to claim 30, wherein said different material contains as a principal ingredient an element of the II*a* or III*b* group of the periodic table.

32. A method of driving an electron beam apparatus according to claim 30, wherein said semiconductor substance contains Si or B and said different material contains at least one of Sr, Ba, Sc and La.

33. A method of driving an electron beam apparatus according to claim 29, wherein said film containing a semiconductor substance is disposed directly on the surface of said higher potential side electroconductive thin film and said electron-scattering plane is formed on the boundary plane of said semiconductor substance and said higher potential side electroconductive thin film.

34. A method of driving an electron beam apparatus according to claim 33, wherein said semiconductor substance contains Si or B.

35. A method of driving an electron beam apparatus according to claim 23, wherein said electron-emitting device further comprises on said lower potential side electroconductive thin film at least in the vicinity of the electron-emitting region a layer of a substance having a work function lower than that of the material of said lower potential side electroconductive thin film.

36. A method of driving an electron beam apparatus according to claim 23, wherein said electron-emitting device further comprises on said lower potential side electroconductive thin film at least in the vicinity of the electron-emitting region a layer of a substance having a melting point higher than that of the material of said lower potential side electroconductive thin film.

37. A method of driving an electron beam apparatus according to claim 36, wherein said high melting point material contains at least one of Nb, Mo, Ru, Hf, Ta, W, Re, Os, Ir, Zr and Rh.

38. A method of driving an electron beam apparatus according to any of claims 23 through 37, wherein it comprises a plurality of electron-emitting devices arranged on the substrate.

39. A method of driving an electron beam apparatus according to claim 38, wherein said plurality of electron-emitting devices are wired by a plurality of row-directional wires and a plurality of column-directional wires to form a matrix wiring arrangement.

40. A method of driving an electron beam apparatus according to claim 38, wherein said plurality of electron-emitting devices are arranged in a ladder-like manner.

41. A method of driving an electron beam apparatus according to any of claims 23 through 37, wherein it further comprises an image-forming member to be irradiated by electron beams emitted from said electron-emitting devices to produce images.

42. A method of driving an electron beam apparatus according to claim 41, wherein said plurality of electron-emitting devices are arranged on the substrate.

43. A method of driving an electron beam apparatus according to claim 42, wherein said plurality of electron-emitting devices are wired by a plurality of row-directional wires and a plurality of column-directional wires to form a matrix wiring arrangement.

44. A method of driving an electron beam apparatus according to claim 42, wherein said plurality of electron-emitting devices are arranged in a ladder-like manner.

* * * * *

UNITED STATES PATENT AND TRADEMARK OFFICE

CERTIFICATE OF CORRECTION

PATENT NO. : 5,866,988

DATED : February 2, 1999

INVENTOR(S) : HITOSHI ODA

It is certified that error appears in the above-identified patent and that said Letters Patent is hereby corrected as shown below:

COLUMN 1

Line 20, "physical" should read --Physical--;
Line 21, "thin-film field emis-" should be deleted;
Line 22, "sion cathodes" should be deleted;
Line 31, "out by" should read --by--;
Line 66, "fissurer." should read --fissures.--.

COLUMN 2

Line 6, "beside" should read --besides--;
Line 15, "the one with" should read --that in--.

COLUMN 3

Line 36, "provide" should read --provided--.

COLUMN 6

Line 63, "the-application" should read --the application--.

UNITED STATES PATENT AND TRADEMARK OFFICE

CERTIFICATE OF CORRECTION

PATENT NO. : 5,866,988

DATED : February 2, 1999

INVENTOR(S) : HITOSHI ODA

It is certified that error appears in the above-identified patent and that said Letters Patent is hereby corrected as shown below:

COLUMN 7

Line 5, "tens of" should be deleted;
Line 21, "nanometers" should read --nanometer--;
Line 47, "tenths" should read --several tenths--;
Line 48, "several nanometers" should read --nanometer--; and "of several" should read --of--;
Line 49, "and" should read --and more--.

COLUMN 9

Line 4, "2a and 3a" should read --11a and 111b--.

COLUMN 10

Line 10, "by-the" should read --by the--.

COLUMN 13

Line 19, "a" should read --an--;
Line 20, "an" should read --a--.

COLUMN 15

Line 1, "denotes" should read --denote--;
Line 33, "is" should read --may--.

UNITED STATES PATENT AND TRADEMARK OFFICE

CERTIFICATE OF CORRECTION

PATENT NO. : 5,866,988

DATED : February 2, 1999

INVENTOR(S) : HITOSHI ODA

It is certified that error appears in the above-identified patent and that said Letters Patent is hereby corrected as shown below:

COLUMN 16

Line 10, "control" should read --to control--.

COLUMN 17

Line 8, "a drive" should read --drive--.

COLUMN 19

Line 9, "am" should read --an--.

COLUMN 22

Line 13, "Step-e" should read --step e--;
Line 16, "Step-f," should read --step f,--.

COLUMN 26

Line 19, "Step-f" should read --step f--.

UNITED STATES PATENT AND TRADEMARK OFFICE

CERTIFICATE OF CORRECTION

PATENT NO. : 5,866,988

DATED : February 2, 1999

INVENTOR(S) : HITOSHI ODA

It is certified that error appears in the above-identified patent and that said Letters Patent is hereby corrected as shown below:

COLUMN 27

Line 5, "Step-f" should read --step f--;
Line 21, "the" (second occurrence) should be deleted;
Line 22, "a" should be deleted; and "same" should read --the same--;
Line 28, "the than" should be deleted;
Line 31, "this" should read --these--.

COLUMN 33

Line 35, "fo for" should read --for--.

Signed and Sealed this

Second Day of November, 1999

*Attest:*

*Attesting Officer*

Q. TODD DICKINSON

*Acting Commissioner of Patents and Trademarks*